US005110718A

United States Patent [19]

Tanji et al.

[11] Patent Number: 5,110,718

[45] Date of Patent: May 5, 1992

[54] SILVER HALIDE PHOTOGRAPHIC SENSITIVE MATERIAL

[75] Inventors: Masaki Tanji; Toyoki Nishijima, both of Odawara, Japan

[73] Assignee: Konica Corporation, Tokyo, Japan

[21] Appl. No.: 627,620

[22] Filed: Dec. 12, 1990

Related U.S. Application Data

[63] Continuation of Ser. No. 371,604, Jun. 26, 1989, abandoned.

[30] Foreign Application Priority Data

Jun. 30, 1988 [JP] Japan ..... 63-160904

[51] Int. Cl.[5] ..... G03C 1/08

[52] U.S. Cl. ..... 430/546; 430/551; 430/554; 430/555; 430/636

[58] Field of Search ..... 430/554, 555, 551, 546, 430/636

[56] References Cited

U.S. PATENT DOCUMENTS

| | | | |
|---|---|---|---|
| 3,516,835 | 6/1970 | Mackey et al. | 430/531 |
| 4,254,216 | 3/1981 | Uchida et al. | 430/551 |
| 4,326,022 | 4/1982 | Ito et al. | 430/546 |
| 4,584,266 | 4/1986 | Hirose et al. | 430/555 |
| 4,587,210 | 5/1986 | Ono et al. | 430/555 |
| 4,738,919 | 4/1988 | Krauss | 430/551 |
| 4,748,100 | 5/1988 | Umemoto et al. | 430/554 |
| 4,748,107 | 5/1988 | Umemoto et al. | 430/554 |
| 4,914,013 | 4/1990 | Ikesu et al. | 430/554 |
| 4,954,431 | 9/1990 | Nishijima et al. | 430/546 |
| 4,987,062 | 1/1991 | Terai et al. | 430/546 |

FOREIGN PATENT DOCUMENTS

| | | |
|---|---|---|
| 137271 | 4/1985 | European Pat. Off. . |
| 2004078 | 3/1979 | United Kingdom . |

OTHER PUBLICATIONS

Patent Abstracts of Japan vol. II, No. 177 (p-583)[2624] Jun. 6, 1987, JPA-62-0705; Jan. 14, 1987.

*Primary Examiner*—Charles L. Bowers, Jr.
*Assistant Examiner*—Thomas R. Neville
*Attorney, Agent, or Firm*—Jordan B. Bierman

[57] ABSTRACT

A silver halide photographic light-sensitive material comprising a support having thereon a photographic silver halide emulsion layer is disclosed. The silver halide emulsion layer contains a magenta coupler represented by Formula I, a compound represented by Formula II and at least one compound selected from the group of compounds represented by Formula III and Formula IV;

Formula I

Formula II

Formula III

Formula IV

13 Claims, No Drawings

SILVER HALIDE PHOTOGRAPHIC SENSITIVE MATERIAL

This application is a continuation of application Ser. No. 07/371,604, filed Jun. 26, 1989, now abandoned.

FIELD OF THE INVENTION

This invention concerns a silver halide photographic light sensitive material, or, in more detail, a light sensitive material in which the retention stability of the despersion solution is improved and has excellent color reproducibility and light-proof and less perspirability.

BACKGROUND OF THE INVENTION

Production of a color image by using a silver halide photographic light sensitive material is carried out through the reaction process in which the main developing agent is oxidized at the same time when the silver halide grains in the light sensitive material are reduced and then the obtained oxidant reacts with a coupler which has been contained in the light sensitive material so as to form a dye. Three kinds of couplers such as yellow, magenta and cyan are usually used so as to reproduce colors by the subtractive color process.

Each coupler is added to a silver halide photographic emulsion by dissolving it in a substantially water-insoluble high-boiling point organic solvent and, if necessary, adding another auxiliary solvent.

Fundamental properties demanded to each coupler are to be highly soluble to the high-boiling point organic solvents and auxiliary solvents, to have a good dispersivity and a good stability in silver halide emulsion so as not to be deposited in it, to have an excellent spectral characteristic which results a good color tone and a distinct color image in a wide range of color-reproducible area and the toughness of the obtained color image to light, heat and humidity.

2-anilino-5-pyrazolones are widely used as the couplers to produce magenta dye. These couplers are inferior in solubility to high-boiling point organic solvent and in light proof and are not satisfactory in color tone. The searching for various kinds of chemical groups to obtain dispersion proofness has been carried out. Among them, acyl amide dispersion-proof group containing a terminal phenoxy group which is described in Japanese Patent Publication Open to Public Inspection (hereinafter referred to as Japanese Patent O.P.I. Publication) Nos. 40804/1976 and 126831/1976 is excellent in solubility and color tone.

However, it is not sufficient in light proof and, moreover, the dispersion solution which uses this coupler is inferior in retention stability.

Various kinds of organic oxidation inhibitors have been developed so as to improve light proof of magenta and other dyes. Examples are the compounds described in Japanese Patent O.P.I. Publication Nos. 72225/1977, 20327/1978, 48538/1979 and 152225/1977. These oxidation inhibitors do, however, not display a sufficient effect to the above-mentioned couplers but represent only incomplete stability and sometimes occur perspiration (a phenomenon to produce oil drop on the surface of the photosensitive material by diffusion and condensation of oil contained in the photosensitive material when it is kept in a high temperature and humidity conditions). Light-proof property of the material can be improved in accordance with the increase of the amount of added oxidation inhibitor but the stability of dispersion solution decreases and the perspiration increases.

The use of surface active agents seems to be effective for the improvement of the stability of dispersion solution. Examples are surface active agents described in Japanese Patent O.P.I. Publication Nos. 46733/1974 and 173470/1987 and Japanese Patent Examined Publication No. 21372/1985. Their effects are, however, not sufficient. Almost of all other surface active agents are good in coating property and antistatic property but are not good in the stabilization of dispersion solution. These weak points can be improved to some extent by the increase of the amount of the added surface active agent; but, at the same time, it causes the increase of perspiration.

Anyhow, it has been impossible to improve all of these properties - color tone, light proof and perspiration and retention stability of the dispersion solution. A method to solve all of these problems at the same time has long been expected.

SUMMARY OF THE INVENTION

The purpose of this invention is to supply an excellent silver halide photographic light sensitive material with which all the problems such as the retention stability of the dispersion solution of magenta coupler, perspiration, tone of the color pigment and light proof after the treatment are improved without failing other photographic and physical properties.

DETAILED DESCRIPTION OF THE INVENTION

The above-mentioned object of this invention can be achieved by a silver halide photographic light-sensitive material comprising a support having thereon a photographic silver halide emulsion layer, wherein said silver halide emulsion layer contains a magenta coupler represented by Formula I, a compound represented by Formula II and at least one compound selected from the group of compounds represented by Formula III and Formula IV;

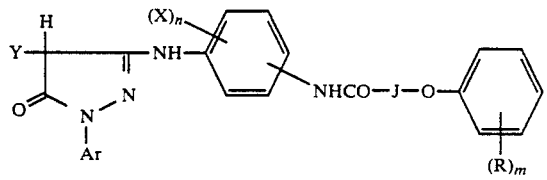

wherein Ar represents an aryl group; Y represents a hydrogen atom or a group capable of releasing by reaction with an oxidation product of a color developing agent; X represents a halogen atom, an alkyl group or an alkoxy group; J represents a divalent bonding group; R represents a halogen atom, a hydroxy group, an alkyl group, an aralkyl group or an alkoxy group; m represents an integer of 0 to 5; n represents an integer of 0 to 4;

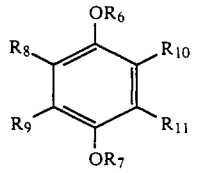

wherein $R_6$ and $R_7$ represent an alkyl group having 2 to 7 carbon atoms or an aralkyl group; $R_8$, $R_9$, $R_{10}$ and $R_{11}$ represent a hydrogen atom, an alkyl group having 4 to 8 carbon atoms or an aralkyl group wherein three or more of $R_8$, $R_9$, $R_{10}$ and $R_{11}$ are not hydrogen atoms at the

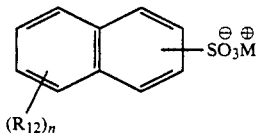

wherein $R_{12}$ represents an alkyl group having 1 to 16 carbon atoms or an aralkyl group; M represents a hydrogen atom or cation; n represents an integer of 1 to 7;

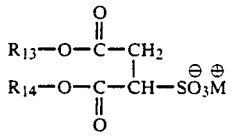

wherein $R_{13}$ and $R_{14}$ represents an alkyl group having 4 to 20 carbon atoms; M represents a hydrogen atom or a cation.

Description of this invention will be given in more detail.

In the above-mentioned Formula, Y is a hydrogen atom or a releasing group; this group means a group which can be released by reaction with the oxidation product of the color developing agent. Actual examples of releasing group are: halogen atoms (chlorine, bromine, fluorine), alkoxy, aryloxy, heterocyclic-oxy, acyloxy, sulfonyloxy, alkoxycarbonyloxy, aryloxycarbonyl, alkyloxalyloxy, alkoxyoxalyloxy, alkylthio, arylthio, heterocyclicthio, alkyloxythiocarbonylthio, acylamino, sulfonamide, nitrogen-containing, alkyloxycarbonylamino, aryloxycarbonylamino groups; Ar represents an aryl group; preferably it is a phenyl group containing a substituent group; preferable substituent is a halogen atom (e.g. fluorine, chlorine, bromine) or an alkyl group (e.g. methyl, ethyl, butyl), an alkoxy group (e.g. methoxy, ethoxy), an aryloxy group (e.g. phenoxy, naphthoxy), an acylamino group (e.g. α-(2,4-di-t-amylphenoxy)butylamide, benzamide), a sulfonylamino group (e.g. hexadecane sulfonamide, benzene sulfonamide), sulfamoyl group (e.g. methylsulfamoyl, phenylsulfamoyl), a carbamoyl group (e.g. butyl carbamoyl, phenyl carbamoyl), a sulfonyl group (e.g. methylsulfonyl, dodecylsulfonyl, benzene sulfonyl), an acyloxy group, an ester group, a carboxyl group, a sulfo group, a cyano group, a nitro group, etc.;

X represents a halogen atom (e.g. chlorine, bromine, fluorine atom) an alkyl group (e.g. methyl, ethyl, i-propyl, butyl, hexyl group) or an alkoxy group (methoxy group, ethoxy group, butoxy group); n is an integer from 0 to 4. When n is more than 2, two or more X's can be either same groups or different ones.

J represents a divalent bonding group; it should preferably be a substituted or unsubstituted alkylene group. More preferably it should be a methylene group having either substituent or not; most preferably, it should be a methylene group having a substituent such as a methylene group, a 1,2-ethylene group, a methyl-methylene group, a ethyl-methylene group, a 1,3-propylene group, a propyl-methylene group and a octyl-methylene group.

R represents a halogen atom, a hydroxy group, an alkyl group, an aralkyl group or an alkoxy group; or preferably be a halogen atom, an alkyl group or an aralkyl group, as a halogen atom, chlorine atom is an example; as an alkyl and an aralkyl group, methyl, ethyl, t-butyl, t-amyl, t-octyl, t-nonyl and n-dodecyl groups are examples; m is an integer from 0 to 5. When m is more than 2, two or more R's can be either same groups or different ones.

Examples of magenta couplers used in this invention are shown in the following; the scope of this invention is not limited to these.

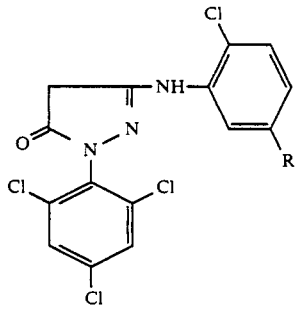

| No. | R |
|---|---|
| I-1 | 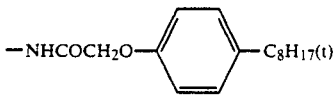 |
| I-2 | 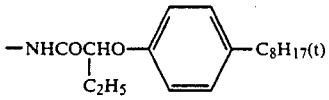 |
| I-3 | 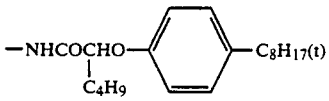 |
| I-4 | 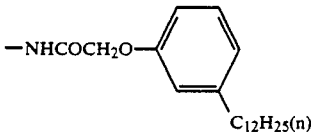 |
| I-5 | 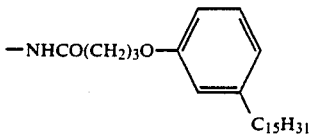 |

-continued
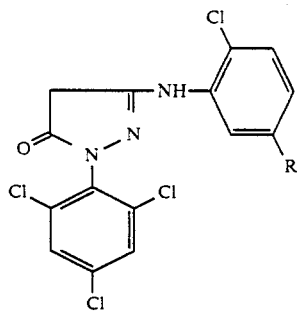
| No. | R |
|---|---|
| I-6 | $-NHCOCH(C_2H_5)-C_6H_4-C_{15}H_{31}$ |
| I-7 | $-NHCOCH_2O-C_6H_4-C_{15}H_{31}$ |
| I-8 | $-NHCOCH_2O-C_6H_4-C_9H_{19}$ |
| I-9 | $-NHCOCH(CH_3)-C_6H_4-C_9H_{19}$ |
| I-10 | $-NHCO(CH_2)_3O-C_6H_4-C_8H_{17}(t)$ |
| I-11 | $-NHCOCH(C_4H_9)-O-C_6H_3(C_5H_{11}(t))-C_5H_{11}(t)$ |
| I-12 | $-NHCOCH(C_3H_7)-O-C_6H_3(C_5H_{11}(t))-C_5H_{11}(t)$ |
| I-13 | $-NHCOCH(C_2H_5)-C_6H_4-C_9H_{19}$ |
| I-14 | $-NHCO(CH_2)_3O-C_6H_4-C_9H_{19}$ |
-continued
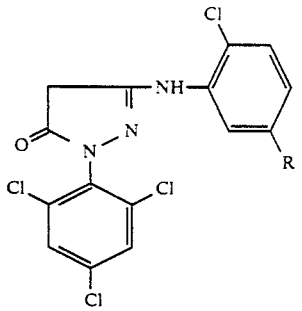
| No. | R |
|---|---|
| I-15 | $-NHCOCH(C_{12}H_{25})-O-C_6H_3(C_4H_9(t))-OH$ |
| I-16 | $-NHCOCH(CH_3)O-C_6H_4-C_8H_{17}(t)$ |
| I-17 | $-NHCOCH(C_8H_{17}(n))O-C_6H_4-C_8H_{17}(t)$ |
| I-18 | $-NHCOCH(C_4H_9(n))O-C_6H_4-C_8H_{17}(t)$ |
| I-19 | $-NHCOCH_2O-C_6H_4-C_{12}H_{25}(n)$ |
| I-20 | $-NHCOCH(C_2H_5)O-C_6H_4-C_{12}H_{25}(n)$ |
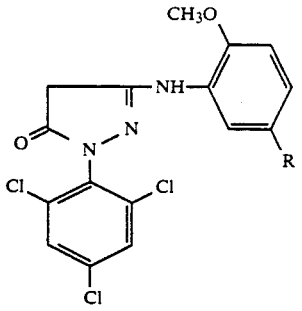
| No. | R |
|---|---|
| I-21 | $-NHCOCH(C_2H_5)O-C_6H_4-C_8H_{17}(t)$ |

-continued
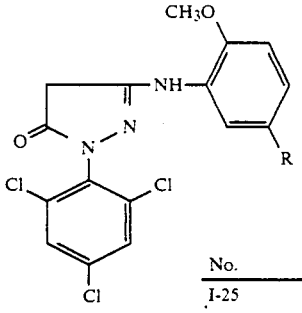
| No. | R |
|---|---|
| I-22 | $-NHCOCHO-(C_6H_4)-C_9H_{19}$, $C_4H_9(n)$ |
| I-23 | $-NHCOCH_2O-(C_6H_4)-C_{12}H_{25}$ |
| I-24 | $-NHCOCHO-(C_6H_4)-C_{15}H_{31}$, $C_2H_5$ |
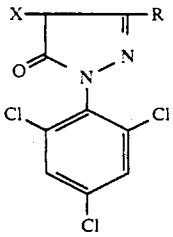
| No. | X | R |
|---|---|---|
| I-25 | H— | $-NH-(C_6H_3(OC_4H_9))-NHCOCHO-(C_6H_4)-C_8H_{17}(t)$, $C_6H_{13}(n)$ |
| I-26 | $-(C_6H_4)-S-(C_6H_3(OC_4H_9))-C_8H_{17}(t)$ | $-NH-(C_6H_3(Cl))-NHCOCH_2O-(C_6H_4)-C_{12}H_{25}$ |
| I-27 | H— | $-NH-(C_6H_4)-NHCOCHO-(C_6H_4)-C_9H_{19}$, $C_4H_9(n)$ |
| I-28 | 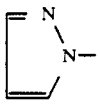 | $-NH-(C_6H_3(Cl))-NHCOCHO-(C_6H_4)-C_8H_{17}(t)$, $C_2H_5$ |

-continued
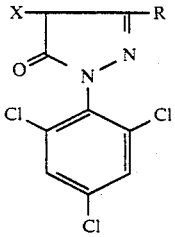
| No. | X | R |
|---|---|---|
| I-29 | H— | 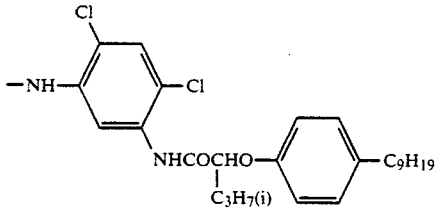 |
| I-30 | 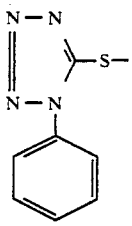 | 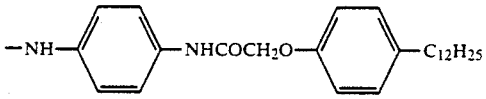 |
| I-31 | 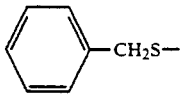 | 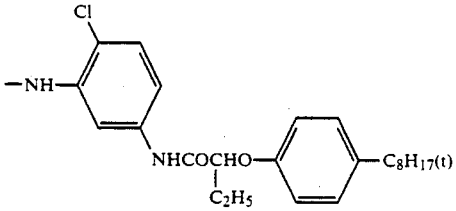 |
| I-32 | $CF_3CONH$— | 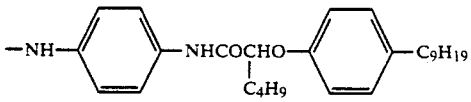 |
| I-33 | 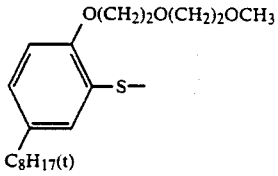 | 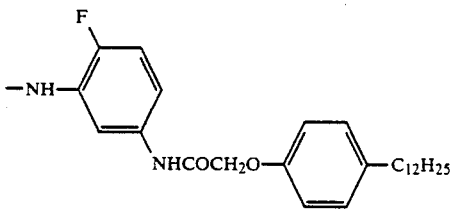 |
| I-34 | 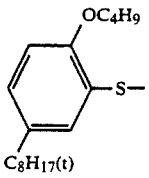 | 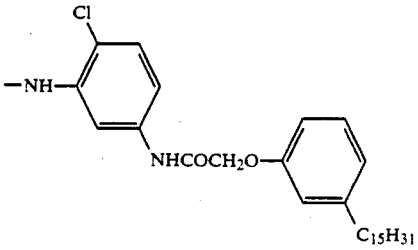 |

-continued
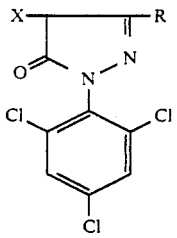
| No. | X | R |
|---|---|---|
| I-35 | 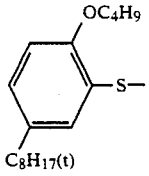 | 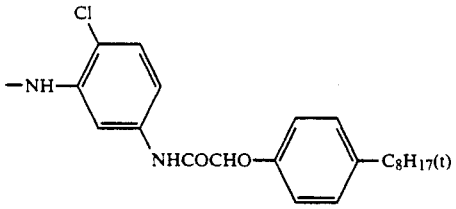 |
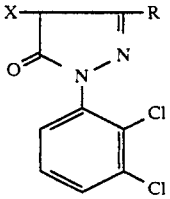
| No. | X | R |
|---|---|---|
| I-36 | H— | 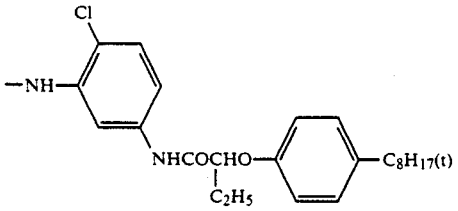 |
| I-37 | 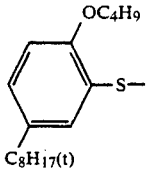 | 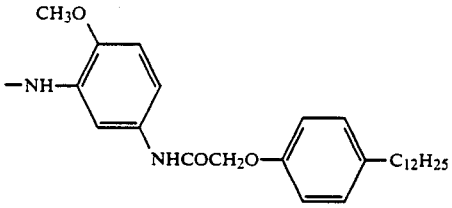 |
| I-38 | H— | 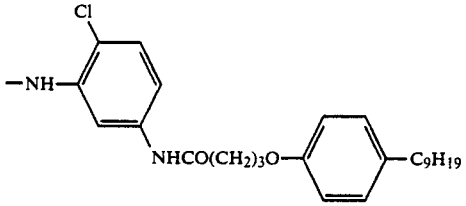 |
| I-39 | 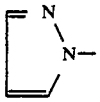 | 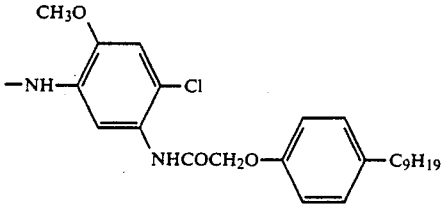 |

-continued
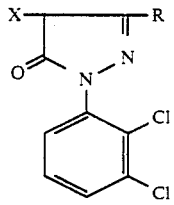
| No. | X | R |
|---|---|---|
| I-40 | H— | 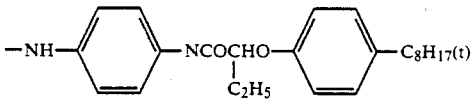 |
| I-41 | $CH_3CO_2$— | 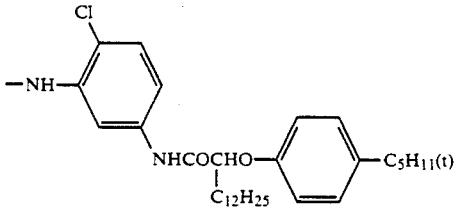 |
| I-42 | | 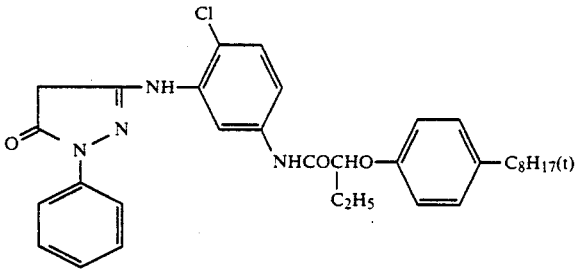 |
| I-43 | | 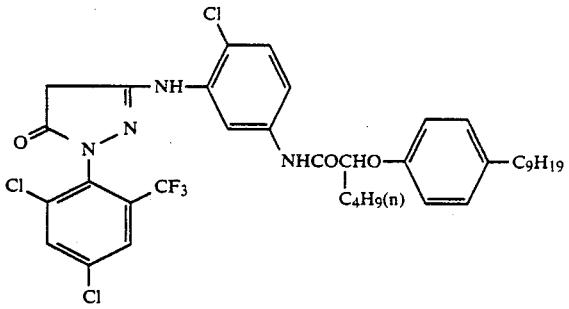 |
| I-44 | | 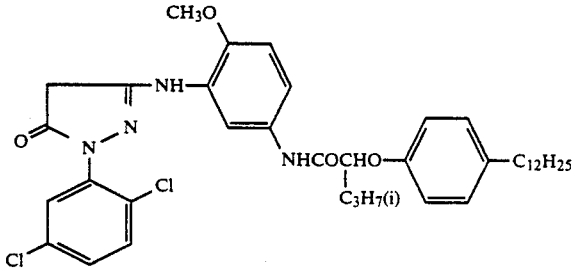 |

-continued

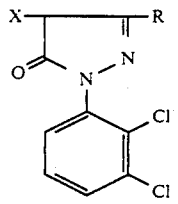

| No. | X | R |
|---|---|---|
| I-45 | 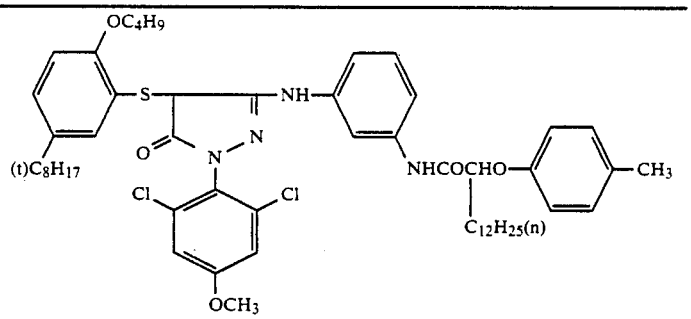 | |
| I-46 | 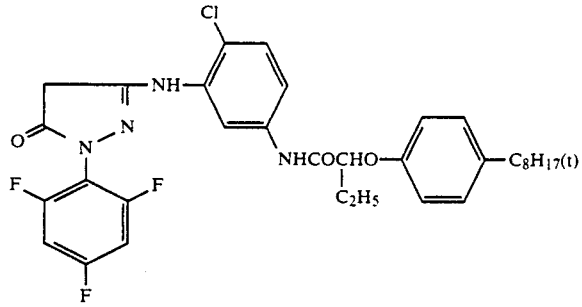 | |

Color-producing coupler is added to the purposing hydrophilic colloid layer singly or mixed with other hydrophobic additives (ultraviolet-ray absorber, color image stabilizer and color-mixture inhibitor) usually by being dissolved in a high-boiling point (b.p. is 150° C. or higher) organic solvent [with the coexistence of other low-boiling point and/or water soluble organic solvent(s), if necessary to be added to a hydrophilic binder such as an aqueous gelatin solution mixed with a surface active agent and emulsified or dispersed by the help of dispersing devices such as stirrer, homogenizer, colloid mill, flow jet mixer or supersonic apparatus. A process of removing a low-boiling point organic solvent can be performed during or at the same time of, dispersion.

A preferable ratio of the used high-boiling point and low-boiling point organic solvents is in a range of 1:0.1 to 1:50; or, more preferably, 1:1 to 1:20 in this invention.

An organic solvent having a dielectric constant less than 6.0 is preferably used as the high-boiling point solvent.

In this invention a high-boiling point solvent having a dielectric constant less than 6.0 should preferably be used. The lowest value of the dielectric constant is not specially limited but it may preferably be not less than 1.9. Esters such as phthalic esters, phosphate esters and organic acid amides, ketones and hydrocarbons having the dielectric constant less than 6.0 can be used.

A high-boiling point organic solvent usable in this invention should preferably be a solvent having the vapor pressure at 100° C. not more than 0.5 mmHg. Phthalic acid esters and phosphate esters having such vapor pressure may be usable more preferably. A mixture of two or more kinds of these solvents are also usable if the dielectric constant of the mixture is less than 6.0. In this invention, dielectric constant values are those measured at 30° C. Usable solvents by mixing are dibutyl phthalate, dimethyl phthalate, tricresyl phosphate and tributyl phosphate.

Preferably usable phthalic acid esters in this invention are those having the below-mentioned Formula (HA).

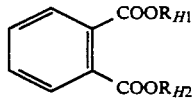

Formula (HA)

where, $R_{H1}$ and $R_{H2}$ are an alkyl and alkenyl or an aryl group, respectively. The sum of the carbon numbers in groups $R_{H1}$ and $R_{H2}$ should be 9 to 32, or, more preferably, be 16 to 24. In this invention, alkyl groups represented by $R_{H1}$ and $R_{H2}$ in the Formula (HA) are straight or branched chain alkyl groups such as butyl, pentyl, hexyl, heptyl, octyl, nonyl, decyl, undecyl, dodecyl, tridecyl, tetradecyl, pentadecyl hexadecyl, heptadecyl and octadecyl groups. Aryl groups represented by $R_{H1}$ and $R_{H2}$ are phenyl and naphthyl groups. Alkenyl groups are hexenyl, heptenyl and octadecenyl groups. These alkyl, and alkenyl aryl groups can either have one or more substituents. Examples of substituents are a halogen atom, alkoxy, aryl, aryloxy, alkenyl and alkoxycarbonyl groups. A substituent group in the aryl group is, e.g. halogen atom, alkyl, alcoxy, aryl, aryloxy, alkenyl and alcoxycarbonyl group. Two or more these substituents can be introduced in one alkyl, alkenyl or aryl group.

In this invention, usable phosphate esters are those represented by Formula (HB).

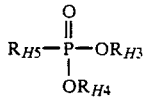

Formula (HB)

in the Formula, $R_{H3}$, $R_{H4}$ and $R_{H5}$ represent, respectively, alkyl, alkenyl or aryl group. The total sum of the carbon atom numbers in the groups, represented by $R_{H3}$, $R_{H4}$ and $R_{H5}$ is 24 to 54.

Where, $R_{H3}$, $R_{H4}$ and $R_{H5}$ are aklkyl groups such as butyl, pentyl, hexyl, heptyl, octyl, nonyl, decyl, undecyl, dodecyl, tridecyl, tetradecyl, pentadecyl, hexadecyl, heptadecyl, octadecyl and nonadecyl groups.

These alkyl, alkenyl and aryl groups can either have one or more substituents. Preferably, $R_{H3}$, $R_{H4}$ and $R_{H5}$ are alkyl groups such as 2-ethylhexyl, n-octyl, 3,5,5-trimethylhexyl, n-nonyl, n-decyl, sec-decyl, sec-dodecyl and t-octyl groups.

Actual examples of organic solvents usable in this invention are shown below; of course, this invention is not limited to these.

Examples of organic Solvents:

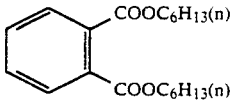

H-1

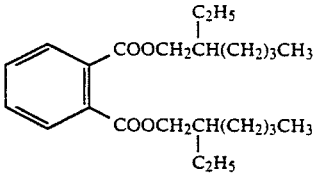

H-2

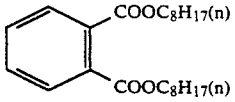

H-3

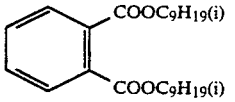

H-4

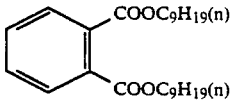

H-5

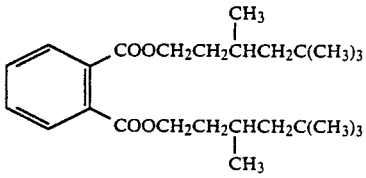

H-6

-continued

Examples of organic Solvents:

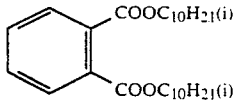

H-7

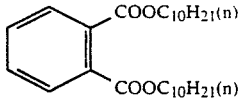

H-8

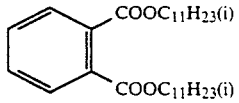

H-9

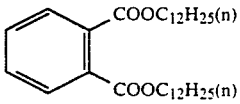

H-10

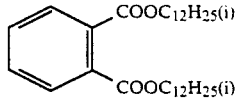

H-11

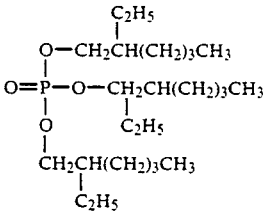

H-12

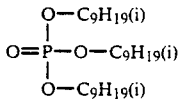

H-13

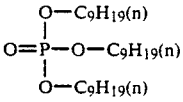

H-14

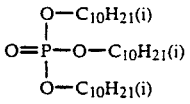

H-15

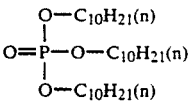

H-16

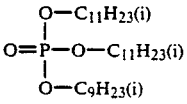

H-17

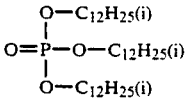

H-18

-continued

Examples of organic Solvents:

H-19

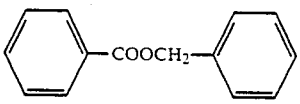

H-20

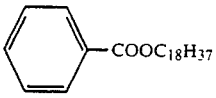

H-21

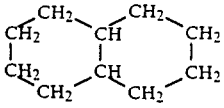

H-22

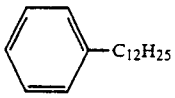

Amount of a high-boiling point organic solvent usable in this invention is 0.01 to 10 mols per one mol of silver halide; or, more preferably, 0.05 to 5 mols.

In this invention, $R_6$ and $R_7$ in compounds represented by the Formula II are either same or different from each other and are an alkyl group having carbon numbers 2 to 7 or an aralkyl group; or, preferably, an alkyl group having carbon numbers 2 to 4, alkenyl or aralkyl group.

Actual examples are: ethyl, propyl, i-propyl, butyl, i-butyl, t-butyl, pentyl, i-pentyl, t-pentyl, hexyl, i-hexyl, t-hexyl, heptyl, i-heptyl, t-heptyl and cyclohexyl groups.

$R_8$, $R_9$, $R_{10}$ and $R_{11}$ are a hydrogen atom or an alkyl, alkenyl or aralkyl group having carbon numbers 4 to 8, respectively; three or more of them should not be hydrogen atoms at the same time.

Actual examples of compounds (II) in this invention are as follows:

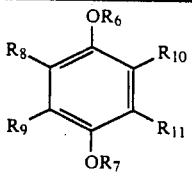

| No. | $R_6$ | $R_7$ | $R_8$ | $R_9$ | $R_{10}$ | $R_{11}$ |
|---|---|---|---|---|---|---|
| II-1 | $C_2H_5$ | $C_2H_5$ | (t)$C_4H_9$ | H | H | (t)$C_4H_9$ |
| II-2 | $C_2H_5$ | $C_2H_5$ | (t)$C_5H_{11}$ | H | H | (t)$C_5H_{11}$ |
| II-3 | (i)$C_3H_7$ | (i)$C_3H_7$ | (t)$C_5H_{11}$ | H | H | (t)$C_5H_{11}$ |
| II-4 | $C_3H_7$ | $C_3H_7$ | (t)$C_5H_{11}$ | H | H | (t)$C_5H_{11}$ |
| II-5 | (i)$C_3H_7$ | (i)$C_3H_7$ | (t)$C_8H_{17}$ | H | H | (t)$C_8H_{17}$ |
| II-6 | $C_4H_9$ | $C_4H_9$ | (t)$C_5H_{11}$ | H | H | (t)$C_5H_{11}$ |
| II-7 | $C_4H_9$ | $C_4H_9$ | (t)$C_8H_{17}$ | H | H | (t)$C_8H_{17}$ |
| II-8 | $C_2H_5$ | $C_2H_5$ | (t)$C_8H_{17}$ | H | H | (t)$C_8H_{17}$ |
| II-9 | $C_3H_7$ | $C_3H_7$ | (t)$C_4H_9$ | H | H | (t)$C_4H_9$ |
| II-10 | $C_3H_7$ | $C_3H_7$ | (t)$C_8H_{17}$ | H | H | (t)$C_8H_{17}$ |
| II-11 | $C_4H_9$ | $C_4H_9$ | (t)$C_4H_9$ | H | H | (t)$C_4H_9$ |
| II-12 | $C_3H_7$ | $C_3H_7$ | $C_4H_9$ | H | H | $C_4H_9$ |
| II-13 | $C_3H_7$ | $C_3H_7$ | $C_4H_9$ | $C_4H_9$ | H | $C_4H_9$ |
| II-14 | $C_3H_7$ | $C_3H_7$ | $C_4H_9$ | $C_4H_9$ | H | H |
| II-15 | (i)$C_3H_7$ | (i)$C_3H_7$ | (t)$C_4H_9$ | H | H | (t)$C_4H_9$ |
| II-16 | $C_5H_{11}$ | $C_5H_{11}$ | (t)$C_4H_9$ | H | H | (t)$C_4H_9$ |

In this invention, $R_{12}$ in compounds represented by Formula III and IV is an alkyl or aralkyl group having carbon number 1 to 16.

Actual examples of $R_{12}$ are i-propyl, butyl, t-butyl, pentyl, t-pentyl, hexyl and dodecyl groups.

$R_{13}$ and $R_{14}$ represent an alkyl group having carbon numbers 4 to 20; or, preferably, alkyl groups substituted by fluorine atom. Examples of $R_{13}$ and $R_{14}$ are nonyl, octyl, dodecyl, octadecyl, octafluoropentyl, octafluoroheptyl and dodecafluoroheptyl groups.

M represents a hydrogen atom or a cation. Actual examples of cation are an ammonium ion and an alkali-metal ion such as sodium and potassium.

Especially preferable compounds of compounds represented by III and IV are those represented by IV. Actual examples of compound III and IV are as follows:

III-1

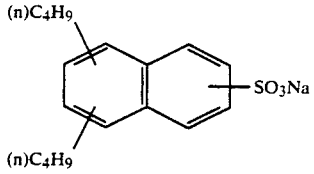

III-2

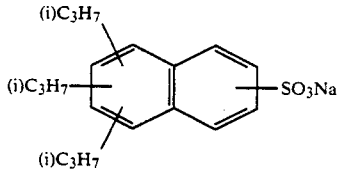

III-3

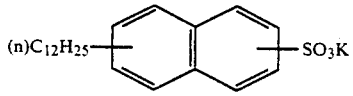

III-4

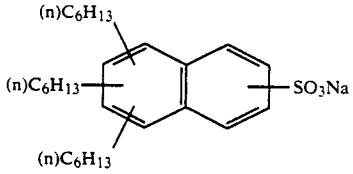

IV-1

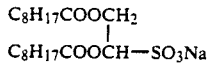

IV-2

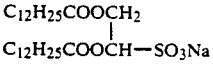

IV-3

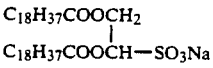

IV-4

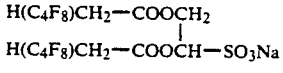

IV-5

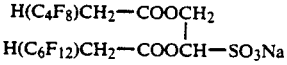

IV-6

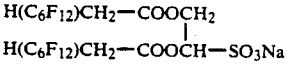

Silver halide photographic light sensitive material of this invention can be used as either the negative of color negative or positive film or color-print paper. And also, it can be either for monochromatic or polychromatic uses. In case of polychromatic silver halide photographic light sensitive material, its constituent layers on the support are composed of mutual accumulation of several layers of silver halide emulsion layers containing photographic couplers of magenta, yellow and cyan and non-light-sensitive layers. Number and order of the accumulation can be changeable properly.

As the silver halide emulsion of this invention, various kinds of silver halides such as silver bromide, silver iodobromide, silver iodochloride silver chlorobromide and silver chloride can be used all of which have been used for conventional silver halide emulsions. A mixture of these silver halide grains are also usable.

Silver halide grain used for the silver halide emulsion can be obtained by acid method, neutral method or ammonia method. They can be developed at one time or after developing the seed grain. The method for making seed grain may be either same as or different from that for developing.

To make silver halide emulsion, halide ion and silver ion can be made by mixing at one time or made by adding one to another. It can also be made and developed by considering the critical developing velocity of silver halide crystal to add halide and silver ions by controlling the pH and pAg of the mixing vessel. After developing the crystals, the composition of halogen in grains can be modified with the conversion method after developing.

During the preparation of the silver halide emulsion, various conditions such as the size, figure, distribution and developing velocity of silver halide grains, can be controlled by using a solvent for silver halide, if necessary.

Silver halide grains used for silver halide emulsion can contain metal ions in their inside and/or on the surface by using cadmium salt, zinc salt, lead salt, thallium salt, iridium salt or its complex salt, rhodium salt or its complex salt, iron salt or its complex salt. A reduction sensitizing nucleus can be built up in their inside and/or on their surface by keeping the grains in a reductive atmosphere.

Unnecessary soluble salts mixed in the silver halide emulsion may either be removed after the development of the silver halide grains or be kept in. For the removal, the method prescribed in Research Disclosure No. 17643 is applicable.

The surface of a silver halide grains of silver halide emulsion may be either the same phase as or different from the inside of the grains.

The latent image of the silver halide grains in the silver halide emulsion may either be built mainly on their surface or be built mainly in their inside.

Crystal form of the silver halide grains in the silver halide emulsion may either be regular or be anomalous such as round or platy type. The ratio of their crystal faces (100) and (111) may be arbitrary. Complex crystal form or a mixture of various crystal forms can also be used.

Two or more kinds of silver halide emulsions which have been prepared separately can also be used after mixing.

The silver halide emulsion can be chemically sensitized with conventional methods. Various sensitizing methods such as the sulfur sensitization which uses a compound containing sulfur reactable with silver ion or uses activated gelatin, the selenium sensitization which uses a selenium compound, reduction sensitization which uses a reducing material or novel metal sensitization method which uses gold or other novel metals. These methods are usable singly or combined.

The silver halide emulsion can be optically sensitized at the desirable wave length zone by using dyes which are known as sensitizing dyes in the photographic industry. Sensitizing of the emulsion can either be performed by using only one sensitizing dye or by mixing two or more kinds of them. A dye which has no optical sensitizing power or a compound which cannot actually absorb visible light but can intensify the sensitizing power of other sensitizing dye (color-intensifying sensitizer) can be mixed in the emulsion.

The silver halide emulsion can contain a fog-inhibitor or a stabilizer known in the photographic industry added during and/or just after the chemical digestion process and/or before the coating of the emulsion for the purpose of fog prevention or stabilization of photographic performance during producing, storage or processing of a photographic material.

It is convenient to use gelatin as the binder (or the protective colloid) for the silver halide emulsion; various other kinds of materials can also be used as the binder such as a gelatin derivative, a grafted polymer of gelatin and another polymer, a protein, a sugar derivative, a cellulose derivative or hydrophilic colloids such as synthetic mono- or co-polymeric hydrophilic high-molecular compounds.

The photographic emulsion layer or the protective colloid of a silver halide photographic material of the present invention can be hardened with the use of a hardener or hardeners to bridging the molecules of binder (or protective colloid). The hardener should preferably be used with the amount just harden the emulsion and not necessary to add the harden any more to the treating solution but it is also possible to add it mixed in the treating solution.

A plasticizer may be added to the silver halide emulsion layer and/or a hydrophilic colloid layer of a silver halide photographic material of the invention to improve their flexibility.

The silver halide emulsion layer or other hydrophilic colloidal layer of the silver halide photo-graphic light sensitive material of this invention can contain water-insoluble or hardly soluble dispersion of synthetic polymer (latex) for the purpose to improve the dimension stability.

A color-forming coupler to perform a coupling reaction with the oxidant of aromatic primary amine developer (e.g. a p-phenylene diamine derivative, aminophenol derivative, etc.) is used for color-developing treatment of emulsion layer of the silver halide photographic light sensitive material of this invention.

As the color-forming coupler, a color to absorb the photosensitive spectral light of each emulsion layer is usually used. That is to say, a yellow-color forming coupler is used for the blue-light sensitive emulsion layer, a magenta-color forming coupler is for the green-light sensitive layer and a cyan-color forming layer for the red-light sensitive layer, respectively. A combination different from the above can, however, be used for some purposes.

Acylacetamide coupler (e.g. benzoyl acetanilides, pivaloylacetanilides) is used as the yellow-color forming coupler. 5-pyrazolone coupler, pyrazolone benzimidazole coupler, pyrazolotriazole coupler and open-chain acylacetonitril coupler are used as the magenta-color forming coupler except for the coupler of this invention. Naphthol coupler and phenol coupler are used as the cyan-color forming coupler. These color-forming couplers should preferably contain a group called as ballast group in its molecule which can make the couplers not to diffuse and, preferably, include the groups containing carbon number 8 or larger. These couplers may be either a four-equivalent type which demands to reduce 4 silver ions to form one molecule of dye or a two-equivalent type which demands to reduce only 2 silver ions.

A color-fog inhibitor can be used to prevent the formation of turbidness of color, the failure in clearness or the formation of remarkable granulation according to the displacement of the oxidant or the electron-transfer agent in the developer in between several emulsion layers (between the layers of the same color and/or between the layers of the different colors) of silver halide photographic light sensitive material of this invention.

This color-fog inhibitor can be applied either to the emulsion itself or to the intermediate layer which is placed between the emulsion layers.

An image-stabilizer is usable so as to prevent the failure of dye image in silver halide photographic light sensitive material of this invention.

Various supplemental layers such as filter layer, halation-preventive layer and/or irradiation-preventive layer can be used in silver halide photographic light sensitive material of this invention. In these layers and/or in emulsion layers, a dyestuff can be contained which is washed out from the color photosensitive material or is bleached during the developing treatment can be contained.

A matting agent can be added to reduce the glossiness of the light sensitive material or to increase its writability or to prevent the adhesion of the material in the emulsion layer and/or other hydrophilic colloid layer of the silver halide photographic light sensitive material of this invention.

A lubricating material can be added in the silver halide photographic light sensitive material of this invention so as to reduce the sliding friction.

An antistatic additive can be added to prevent the electrostatic charge in the silver halide photographic light sensitive material of this invention. It can be applied either on the support at its non-emulsion side or in the emulsion layer and/or on the protective colloid layer (except the emulsion layer itself) on the support at its emulsion side. In this invention, these various photographically profitable additives are finely dispersed in the hydrophilic colloid as water-in-oildrop type oil-protective dispersion.

The photographically profitable additives described here are water-insoluble compounds such as ultraviolet-ray absorber, dye-image fading inhibitor, dye-image forming coupler, fog inhibitor, color-mixing inhibitor and redox compounds, etc.

To make the water-in-oildrop dispersion, conventional methods to disperse hydrophobic additives such as couplers can be applicable. Usually, a high boiling point organic solvent (b.p. over 150° C.) containing, if necessary, low-boiling point or water-soluble organic solvent is dispersed in a hydrophilic binder such as aqueous gelatin solution as emulsification dispersion by using a surface active agent with a stirrer, homogenizer, colloid mill, flow-jet mixer or ultrasonic apparatus. Then, the mixture is added into the purposing hydrophilic colloid. A process of removing a low-boiling point organic solvent can be performed during or at the same time of, dispersing.

Various kinds of surface active agents can be used in the photographic emulsion and/or other hydrophilic colloid layer of the silver halide photographic light sensitive material of this invention for the purpose to improve the coating ability, to prevent the electrostatic charge, to improve smoothness, to make emulsified dispersion, to prevent adhesion and to improve other photographic properties (developing-acceleration, contrast increase and sensitizing, etc.). Various kinds of materials can be used as the support of the silver halide photographic light sensitive material of this invention as follows: flexible reflection support such as paper and synthetic paper laminated with baryta layer or α-olefin polymer; films of semi-synthetic and synthetic high polymers such as acetyl cellulose, nitrocellulose, polystyrene, polyvinyl chloride, polyethylene telephthalate, polycarbonate and polyamide; and rigid bodies such as glass, metals and porcelain.

In this invention, the silver halide photographic light sensitive layer can be coated and formed on the surface of the support, which is, if necessary, subject to the treatment such as corona discharge, ultraviolet radiation and flaming, directly or intervened with an undercoat layer (one, two or more than two layers placed for the purpose to improve the adhesivity of support surface, prevention of electrostatic charge, size-stability, anti-abrasiveness, hardness, halation prevention, friction characteristics and/or other characteristics).

At the coating of the silver halide photographic light sensitive layer, a thickener can be used to improve the coating ability. Extrusion coating and curtain coating are especially profitable both of which can coat two or more layers at the same time.

The silver halide photographic light sensitive material of this invention can be exposed with electromagnetic wave having the spectral range where the emulsion composing the photographic material of this invention can react. Various kinds of light sources can be used such as natural light (sun beam), tungsten light, fluorescent light, mercury lamp, xenone-arc lamp, carbon-arc lamp, xenone flush light, cathode-ray flying spot, various laser-beam, light-emitting diode, the light emitted from fluorescent body excited with electron beam, X-ray, γ-ray, α-ray.

Exposure time is from one millisecond to one second which is from the ordinary exposure time of ordinary camera to the time shorter than one millisecond such as the exposure with cathode ray or xenone flush light (100–1 microsecond); exposure longer than one second is also possible which is either continuously or intermittently.

The silver halide photographic light sensitive material of this invention can compose a color image by developing with color-developing methods conventional in the photographic world.

Various conventional developers of aromatic primary amines used for various color photographic processes are usable as the developing agent. Aminophenol type and p-phenylenediamine type developers are included. These compounds are usually used as their chlorides or sulfates since they are more stable than free amine type. The usable concentration of these compounds is about 0.1 to 30 g/l of developing solution; or, preferably, about 1 to 15 g/l.

Examples of aminophenol type developers are: α-aminophenol, p-aminophenol, 5-amino-2-oxytoluene, 2-amino-3-oxytoluene, 2-oxy-3-amino-1,4-dimethylbenzene.

Especially useful primary aromatic amino-type color developers are N,N'-dialkyl-p-phenylenediamine type compounds. Their alkyl and phenyl group can be substituted with some substituent groups. Especially profitable ones are: N,N'-diethyl-p-phenylene diamine hydrogen chloride, N-methyl-p-phenylene diamine hydrogen chloride, N,N'-dimethyl-p-phenylelnediamine hydrogen chloride, 2-amino-5-(N-ethyl-N-dodecylamino)-toluene, N-ethyl-N-β-methane sulfonamideethyl-3-methyl-4-aminoaniline sulfate, N-ethyl-N-β-hydroxyethyl amino aniline, 4-amino-3-methyl-N,N'-diethyl aniline, 4-amino-N-(2-methoxyethyl)-N-ethyl-3-methyl aniline-p-toluene sulfonate.

Color developers used for the treatment of this invention can contain various components conventionally used as the additives for the above-mentioned aromatic primary amine type developer such as: alkaline compounds such as sodium hydroxide, sodium carbonate, potassium carbonate; sulfites of alkali metals, bisulfites of alkali metals, thiocyanates of alkali metals, alkali metal halides, benzyl alcohol, water-softening agents and concentrating agents. Applicable pH of the color developer solution is usually higher than 7; or, more usually, about 10 t0 13. After the color development, the photographic light sensitive material of this invention is treated with some solution which has fixing ability. When this solution is a fixing solution the bleaching treatment is carried out beforehand. Various kinds of metal complex salts of organic acids can be used as the bleacher. The metal complexes are used for the purpose to oxidize the metalic silver produced by developing to silver halide and simultaneously to develop the color in the not-developed part of the color developer. Preferable organic acid used in these metal complexes are aminopolycarboxylic acids, oxalic acid and citric acid; as the metal coordinate, iron, cobalt and copper are usable. Most preferable organic acids are polycarboxylic acid and aminopoly carboxylic acids and their alkali-metal salts, ammonium salts and water-soluble amine salts. Their actual examples are:

[1] Ethylenediamine tetraacetic acid
[2] Nitrotriacetic acid
[3] Iminodiacetic acid
[4] Disodium ethylene diaminetetraacetate
[5] Tetra(trimethylammonium) ethylenediaminetetraacetate
[6] Tetrasodium ethylenediamine tetraacetate
[7] Sodium nitrotriacetate Used bleaching solution contains above-mentioned metal complex salts of organic acids as the bleachers and also can contain various additives. Preferable additives are: rehalogenized agents such as ammonium halides, for example, potassium bromide, sodium bromide, sodium chloride and ammonium bromide; metal salts and chelate compounds.

It is also possible to use various compounds conventionally used as additives for bleachers are also usable: pH buffering salts such as borates, oxalates, acetates, carbonates and phosphates and alkyl amines and polyethylene oxides.

Usable fixers and bleaching fixers are as follows: various bisulfites such as ammonium sulfite, potassium sulfite, ammonium bisulfite, potassium bisulfite, sodium bisulfite, ammonium metabisulfite, potassium metabisulfite, sodium metabisulfite; various pH buffer agents containing various salts such as boric acid, borax, sodium hydroxide, potassium hydroxide, sodium carbonate, potassium carbonate, sodium bisulfite, sodium bicarbonate, potassium bicarbonate, acetic acid sodium acetate and ammonium hydroxide; these can be used singly or by mixing two or more.

In case when a supplementing agent for bleach-fixer is added to the main bleach-fixer (or fixing bath), a thiosulfate, thiocyanate or sulfite can either be added to the bleach-fixer (bath) or can be contained in the supplementing solution and then added to the bath.

In this invention, air or oxygen can be blowed into the bleach-fixing bath and in the storage tank of bleach-fixer supplementing solution so as to increase the activity of bleach-fixer. Or, an oxidizing agent such as hydrogen peroxide, a bromate or a persulfate can be added with a proper amount.

EXAMPLES

The content of this invention should be explained with practical examples, hereinafter; the content of this invention is, however, not limited to this.

Example 1

Magenta coupler (M-1) 60 g, color image stabilizer (ST-3) 15 g, addition compound (AO-1) 40 g and stain inhibitor (HQ-1) 1.7 g were dissolved in a high-boiling point organic solvent (DBP) 40 ml and ethyl acetate 100 ml. The solution was dispersed in a 5% gelatin aqueous solution containing dispersion additive (saponin) 5 g by using an ultrasonic homogenizer. The dispersed solution (1500 ml) was obtained. This dispersed solution was then added into the coating solution—an aqueous gelatin solution (3%; 1000 ml). Green-sensitive coating solution was prepared by adding a green-sensitive silver chlorobromide emulsion (containing 80 mol % silver bromide) 400 g to the above mixture. Coating solutions for other layers were than prepared with similar methods. These coating solutions were then coated in order on the support (polyethylene-coated paper) so as to make the emulsion composition shown in Table 1.

TABLE 1

| Layer | Composition | Addition amount ($g/m^2$) |
|---|---|---|
| 7th layer (protective layer) | Gelatin | 1.0 |
| 6th layer (ultraviolet-absorbing layer) | Gelatin | 0.6 |
| | Ultraviolet-ray absorber (UV-1) | 0.2 |
| | Ultraviolet-ray absorber (UV-2) | 0.2 |
| | Color-mixing inhibitor (HQ-1) | 0.01 |
| | DBP | 0.2 |
| | PVP | 0.03 |
| | Anti-irradiation dye (AI-2) | 0.02 |
| 5th layer (red-sensitive layer) | Gelatin | 1.40 |
| | Red-sensitive silver chlorobromide emulsion (silver bromide 80 mol %); as silver | 0.24 |
| | Cyan coupler (C-1) | 0.17 |
| | Cyan coupler (C-2) | 0.25 |
| | Dye image stabilizer (ST-1) | 0.20 |
| | Stain inhibitor (HQ-1) | 0.01 |
| | DBP | 0.30 |
| 4th layer (ultraviolet absorbing layer) | Gelatin | 1.30 |
| | Ultraviolet-ray absorber (UV-1) | 0.40 |
| | Ultraviolet-ray absorber (UV-2) | 0.40 |
| | Color-mixing inhibitor (HQ-1) | 0.03 |
| | DBP | 0.40 |
| 3rd layer (green-sensitive layer) | Gelatin | 1.40 |
| | Green-sensitive silver chlorobromide emulsion (silver bromide 80 mol %); as silver | 0.27 |
| | Magenta coupler (M-1) | 0.35 |

TABLE 1-continued

| Layer | Composition | Addition amount ($g/m^2$) |
|---|---|---|
| | Dye image stabilizer (ST-3) | 0.09 |
| | Addition compound (AQ-1) | 0.23 |
| | Stain inhibitor (HQ-1) | 0.01 |
| | High-boiling point organic solvent (DBP) | 0.23 |
| | Anti-irradiation dye (AI-1) | 0.01 |
| 2nd layer (intermediate layer) | Gelatin | 1.20 |
| | Color mixing inhibitor (HQ-1) | 0.12 |
| | DBP | 0.15 |
| 1st layer | Gelatin | 1.30 |

TABLE 1-continued

| Layer | Composition | Addition amount ($g/m^2$) |
|---|---|---|
| (blue-sensitive layer) | Blue-sensitive silver chlorobromide emulsion (silver bromide 80 mol %): as silver | 0.30 |
| | Yellow coupler (Y-1) | 0.80 |
| | Dye image stabilizer (ST-1) | 0.30 |
| | Stain inhibitor (HQ-1) | 0.02 |
| | DBP | 0.20 |
| Support | Polyethylene laminate paper | |

Y-1

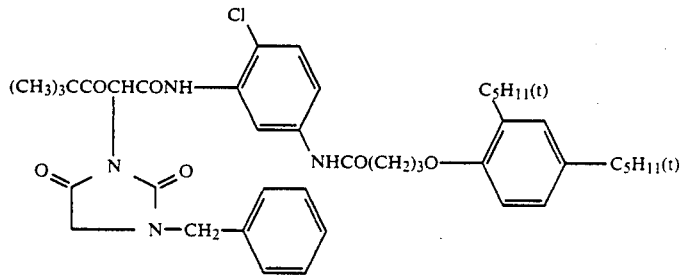

M-1

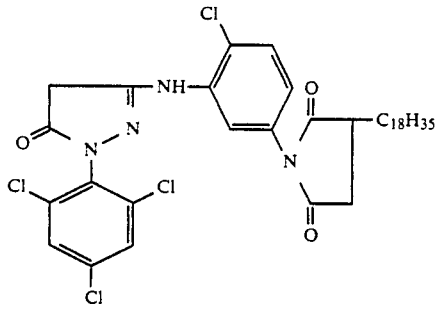

C-1

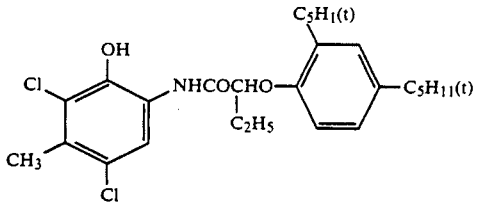

C-2

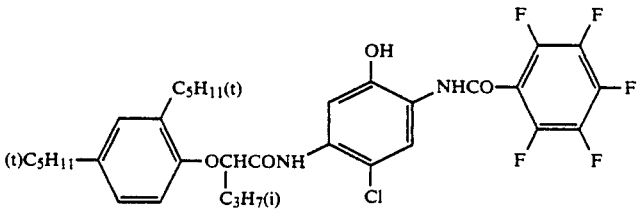

ST-1

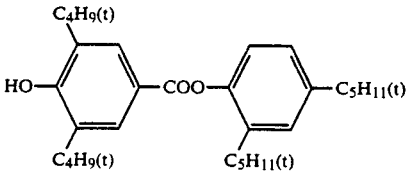

-continued
UV-1
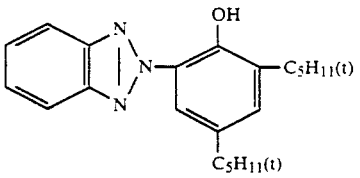
UV-2
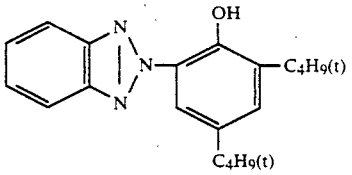
DBP (dibutyl phthalate)
PVP (polyvinyl pyrrolidone)
HQ-1
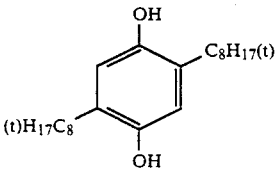
AO-1
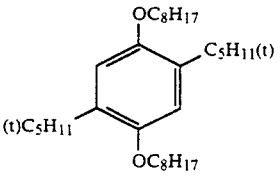
ST-3
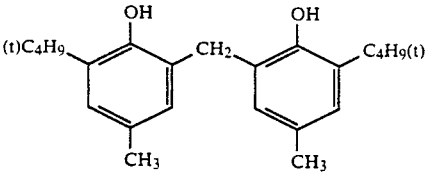
AI-1
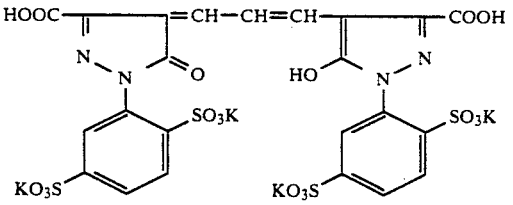
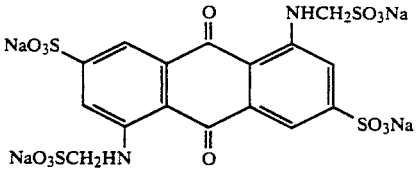
Silver halide emulsions of layers was sensitized by using sensitizing dyes mentioned below:
Red-sensitive emulsion
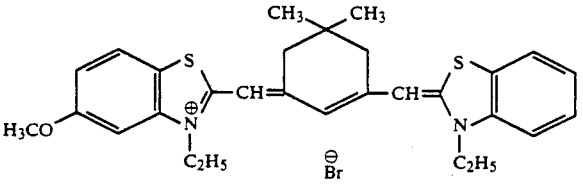

-continued

Green-sensitive emulsion

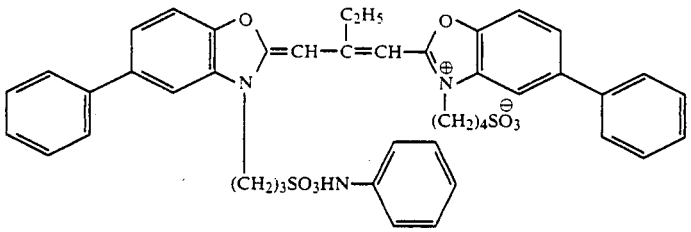

Blue-sensitive emulsion

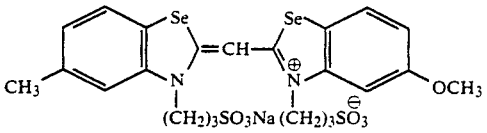

Hardeners (H-1 and H-2), white-ground controllers (W-1, W-2, W-3) and antifugal agents (K-1) are also used.

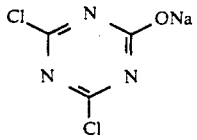

H-1

$C(CH_2SO_2CH{=}CH_2)_4$

H-2

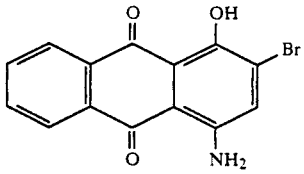

W-1

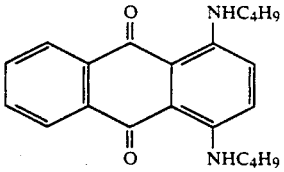

W-2

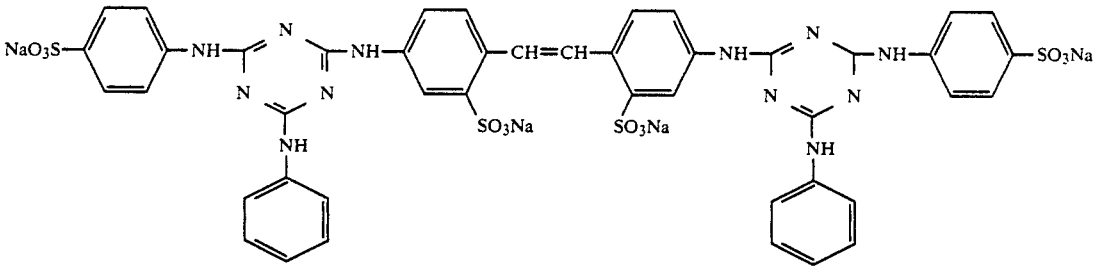

W-3

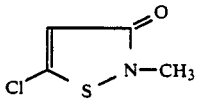

K-1

The coated sample made by the above recipe names Sample 1. Samples 2 to 35 were prepared by same recipe as the above except that the magenta coupler (M-1) in the 3rd layer of the Sample 1, the addition compound (AO-1), dispersion additive (saponin) and high-boiling point organic solvent (DBP) are changed as shown in Table 2.

Optical-wedge exposure is given with green light by using a photographic sensitometer (Konica Co. KS-7) to these samples and then treated as follows:

| Treating process | Treat temp. | Treat time |
|---|---|---|
| Color developing | 32.8° C. | 3 min 30 sec |
| Bleach-fixing | 32.8° C. | 1 min 30 sec |
| Washing with water | 32.8° C. | 3 min 30 sec |

(Composition of color developer)

One liter of color developer contains:

| | |
|---|---|
| N-ethyl-N-β-methane sulfonamido ethyl-3-methyl-4-aminoaniline sulfate | 4.0 g |
| Hydroxylamine sulfate | 2.0 g |
| Potassium caponate | 25.0 g |
| Sodium chloride | 0.1 g |
| Sodium bromide | 0.2 g |
| Anhydrous sodium sulfite | 2.0 g |
| Benzyl alcohol | 10.0 ml |
| Polyethylene glycol (mean polymerization degree: 400) | 3.0 ml |

pH is adjusted to 10.0 with sodium hydroxide.

(Composition of bleach-fixing solution)

One liter of bleach-fixing solution contains:

| | |
|---|---|
| Ethylenediaminetetraacetato-iron sodium salt | 60.0 g |

-continued

| | |
|---|---|
| Sodium thiosulfate | 100.0 g |
| Sodium bisulfite | 20.0 g |
| Sodium metabisulfite | 5.0 g |
| pH is adjusted to 7.0 with sulfuric acid. | |

The color tone of the obtained magenta dye image, light-fastness, perspiration and the static-stability of the dispersed solution were tested with the below-mentioned method. The obtained result is shown in Table 2.

COLOR TONE

Evaluation was carried out about the maximum absorption wave length (λmax) at the magenta dye image.

Light fastness test

Test was carried out by using an underglass outdoor sun-beam exposure table and the result was represented as the residual ratio of the initial density Do=1.0 when the sample was exposed to sun-beam for 30 days.

$$\text{Residual ratio } (\%) = \frac{D}{Do} \cdot 100$$

(D=green color density after the color faded)

STATIC STABILITY TEST OF COUPLER DISPERSION

The coupler dispersive solution obtained with the above-mentioned method was stored in a thermostat at 40° C. for 10 hours and the turbidity was measured concerning the mean diameter of grains of the dispersive solution before and after the storage by using Poic integral-sphere turbidimeter (Nippon Seimitsu Kogaku Co.). Turbidity represents smaller the better.

Perspiration

The treated sample was kept under the conditions 80° C. and 60% RH for 4 weeks and then the oily component developed on the surface was taken and measured by weight. Visual observation was also carried out.

TABLE 2

| Sample No. | M coupler | Addition compound | Dispersion additive | High-boiling point organic solvent | Color tone | Light fastness | Dispersion stability Before the stop | Dispersion stability After the stop | Perspiration Amount of perspiration (mg/cm²) | Condition of the surface |
|---|---|---|---|---|---|---|---|---|---|---|
| 1 (Comparative) | M-1 | AO-1 | Saponin | DBP | 529 | 77 | 25.4 | 65.3 | 0 | No perspiration |
| 2 (Comparative) | M-1 | II-2 | Saponin | DBP | 529 | 76 | 23.6 | 73.8 | 0 | No perspiration |
| 3 (Comparative) | I-2 | AO-1 | Saponin | DBP | 534 | 54 | 26.4 | 325 | 0.07 | Small amount perspiration |
| 4 (Comparative) | I-2 | II-2 | Saponin | DBP | 534 | 75 | 22.2 | 250 | 0.11 | Develop of oily drop |
| 5 (Comparative) | I-2 | AO-1 | IV-4 | DBP | 534 | 52 | 23.8 | 316 | 0.08 | Develop of oily drop |
| 6 (Invention) | I-2 | II-2 | IV-4 | DBP | 534 | 78 | 22.8 | 52.0 | 0.01 | No perspiration |
| 7 (Invention) | I-2 | II-3 | IV-4 | DBP | 535 | 77 | 20.5 | 50.1 | 0.01 | No perspiration |
| 8 (Invention) | I-2 | II-6 | IV-4 | DBP | 534 | 78 | 24.2 | 43.5 | 0 | No perspiration |
| 9 (Invention) | I-2 | II-1 | IV-4 | DBP | 534 | 76 | 23.5 | 48.1 | 0 | No perspiration |
| 10 (Invention) | I-2 | II-9 | IV-4 | DBP | 534 | 76 | 25.6 | 39.5 | 0 | No perspiration |
| 11 (Invention) | I-2 | II-11 | IV-4 | DBP | 534 | 76 | 23.3 | 36.1 | 0 | No perspiration |
| 12 (Invention) | I-1 | II-6 | IV-4 | DBP | 535 | 75 | 20.2 | 48.3 | 0.01 | No perspiration |
| 13 (Invention) | I-1 | II-11 | IV-4 | DBP | 535 | 74 | 21.8 | 45.5 | 0.01 | No perspiration |
| 14 (Invention) | I-6 | II-2 | IV-4 | DBP | 534 | 75 | 27.7 | 42.8 | 0.01 | No perspiration |
| 15 (Invention) | I-6 | II-9 | IV-4 | DBP | 534 | 77 | 25.3 | 39.9 | 0 | No perspiration |
| 16 (Invention) | I-6 | II-11 | IV-4 | DBP | 534 | 77 | 21.0 | 35.4 | 0 | No perspiration |
| 17 (Invention) | I-6 | II-6 | IV-4 | DBP | 534 | 79 | 23.1 | 38.7 | 0 | No perspiration |
| 18 (Invention) | I-11 | II-6 | IV-4 | DBP | 533 | 78 | 24.4 | 39.9 | 0 | No perspiration |
| 19 (Invention) | I-11 | II-2 | IV-4 | DBP | 534 | 77 | 25.1 | 43.5 | 0 | No perspiration |
| 20 (Invention) | I-11 | II-11 | IV-4 | DBP | 534 | 75 | 23.9 | 40.1 | 0 | No perspiration |
| 21 (Invention) | I-21 | II-6 | IV-4 | DBP | 535 | 79 | 23.3 | 35.6 | 0 | No perspiration |
| 22 (Invention) | I-21 | II-11 | IV-4 | DBP | 535 | 75 | 25.8 | 33.3 | 0 | No perspiration |
| 23 (Invention) | I-21 | II-2 | IV-4 | DBP | 534 | 75 | 22.0 | 38.2 | 0 | No perspiration |
| 24 (Invention) | I-2 | II-11 | III-2 | DBP | 535 | 80 | 28.0 | 37.0 | 0.005 | No perspiration |
| 25 (Invention) | I-2 | II-11 | IV-1 | DBP | 535 | 81 | 27.5 | 32.0 | 0 | No perspiration |
| 26 (Invention) | I-2 | II-6 | IV-4 | H-2 | 535 | 81 | 22.1 | 35.4 | 0 | No per- |

TABLE 2-continued

| Sample No. | M coupler | Addition compound | Dispersion additive | High-boiling point organic solvent | Color tone | Light fastness | Dispersion stability Before the stop | Dispersion stability After the stop | Perspiration Amount of perspiration (mg/cm²) | Condition of the surface |
|---|---|---|---|---|---|---|---|---|---|---|
| | | | | | | | | | | spiration |
| 27 (Invention) | I-2 | II-11 | IV-4 | H-2 | 534 | 80 | 21.0 | 33.8 | 0 | No perspiration |
| 28 (Invention) | I-2 | II-6 | IV-4 | H-7 | 534 | 82 | 23.6 | 30.5 | 0 | No perspiration |
| 29 (Invention) | I-2 | II-11 | IV-4 | H-7 | 534 | 82 | 26.2 | 31.9 | 0 | No perspiration |
| 30 (Invention) | I-21 | II-11 | IV-4 | H-2 | 534 | 81 | 26.0 | 32.2 | 0 | No perspiration |
| 31 (Invention) | I-21 | II-11 | IV-4 | H-7 | 534 | 81 | 21.3 | 35.0 | 0 | No perspiration |
| 32 (Invention) | I-2 | II-6 | IV-1/IV-4 | H-2 | 534 | 82 | 22.8 | 30.2 | 0 | No perspiration |
| 33 (Invention) | I-2 | II-6 | IV-1/IV-4 | H-7 | 534 | 83 | 24.9 | 31.0 | 0 | No perspiration |
| 34 (Invention) | I-2 | II-11 | IV-1/IV-4 | H-2 | 534 | 82 | 22.3 | 30.5 | 0 | No perspiration |
| 35 (Invention) | I-2 | II-11 | IV-1/IV-4 | H-7 | 534 | 84 | 24.6 | 29.7 | 0 | No perspiration |

As can be seen in Table 2, color tone of Samples 1 and 2 which comparative magenta couplers were used indicates to be inclined to shorter wave side. Among Sample 3 and the followings which magenta coupler of the invention were used indicate that the color tones were fine since the wave length moves 4–6 nm to the longer side. Sample 3, combined with AO-1 indicates that the light fastness was inferior and, moreover, both the static stability of the dispersion solution and perspiration are remarkably inferior. On the other hand, Sample 4 which was combined with the addition compound of this invention indicates that the light fastness was much improved but the dispersion stability was hardly improved and perspiration was worsen with the creation of oily drop.

Sample 5 (combination with the dispersion additive of this invention) indicates almost no good effect either light fastness, dispersion stability or perspiration. Sample 6 (this invention) indicates the improvement effect unexpected from past experiences in light fastness, dispersion stability and perspiration. The effect of this invention was multiplied more by the additional use of a high-boiling point organic solvent having a low dielectric constant as indicated in the results of Samples 26 and after.

A similar effect was obtained by applying the sample of this invention to the support made of polyethylene terephthalate containing silica and titanium oxide.

Example 2

Multi-layered silver halide color photographic light sensitive material (Sample 36) was prepared by coating the layers whose compositions were as indicated in Table 3 on the paper support whose one side was coated with polyethylene and other side was laminated with polyethylene containing titanium oxide in its first layer.

Used silver halide emulsion was prepared as follows.

[Preparation of blue-sensitive silver halide emulsion]

Solution A and Solution B whose compositions were indicated below were added into a 2% gelatin solution 1000 ml (40° C.) concurrently in about 30 minutes and controlling pAg at 6.5 and pH at 3.0. And then, Solution C and Solution D were added concurrently in about 180 minutes and keeping pAg to 7.3 and pH to 5.5.

The control of pAg was carried out with the method described in Japanese Patent O.P.I. Publication No. 45437/1984. The control of pH was carried out by using sulfuric acid or sodium hydroxide.

| | |
|---|---|
| (Solution A) | |
| NaCl | 3.42 g |
| KBr | 0.03 g |
| By adding water to | 200 ml |
| (Solution B) | |
| $AGNO_3$ | 10 g |
| By adding water to | 200 ml |
| (Solution C) | |
| NaCl | 102.7 g |
| KBr | 1.0 g |
| By adding water to | 600 ml |
| (Solution D) | |
| $AGNO_3$ | 300 g |
| By adding water to | 600 ml |

After the addition, the mixture was desalted with a mixture of Demal N (a product of Kao Co., 5% aqueous solution) and a magnesium sulfate solution (20%) and mixed with gelatin solution. The obtained product was monodispersed cubic emulsion EMP-1 which has mean diameter 0.85 μm, variation constant $(\sigma/\bar{r})=0.07$, silver chloride content 99.5 mol %.

This EMP-1 emulsion was chemically repened by using the below-mentioned compounds at 50° C. for 90 minutes and the blue sensitive silver halide emulsion (EmA) was obtained.

| | |
|---|---|
| Sodium thiosulfate | 0.8 mg/mol AgX |
| Chloroauric acid | 0.5 mg/mol AgX |
| Stabilizer SB-5 | $6 \times 10^{-4}$ mol/mol AgX |
| Sensitizing dye D-1 | $5 \times 10^{-4}$ mol/mol AgX |

PREPARATIVE METHOD OF GREEN SENSITIVE SILVER HALIDE EMULSION

The method is just similar to that of EMP-1 except changing the addition time of A solution and B solution and that of C solution and D solution. Obtained emulsion (EMP-2) is a monodispersed cubic emulsion having mean diameter 0.43 μm, variation constant $(\sigma/\bar{r})=0.08$, silver chloride content 99.5 mol %.

This EMP-2 was chemically ripened by using below-mentioned compounds at 55° C. for 120 minutes and the green sensitive silver halide emulsion (EmB) was obtained.

| | |
|---|---|
| Sodium thiosulfate | 1.5 mg/mol AgX |
| Chloroauric acid | 1.0 mg/mol AgX |
| Stabilizer SB-5 | $6 \times 10^{-4}$ mol/mol AgX |
| Sensitizing dye D-2 | $4 \times 10^{-4}$ mol/mol AgX |

PREPARATIVE METHOD OF RED SENSITIVE SILVER HALIDE EMULSION

The method is just similar to that of EMP-1 except changing the addition time of A solution and B solution and that of C solution and D solution. Obtained emulsion (EMP-3) is a monodispersed cubic emulsion having mean diameter 0.50 μm, variation constant $(\sigma/\bar{r})=0.08$, silver chloride content 99.5 mol %.

This EMP-3 was chemically ripened by using below-mentioned compounds at 60° C. for 90 minutes and the red sensitive silver halide emulsion (EmC) was obtained.

| | |
|---|---|
| Sodium thiosulfate | 1.8 mg/mol AgX |
| Chloroauric acid | 2.0 mg/mol AgX |
| Stabilizer SB-5 | $6 \times 10^{-4}$ mol/mol AgX |
| Sensitizing dye D-2 | $8 \times 10^{-4}$ mol/mol AgX |

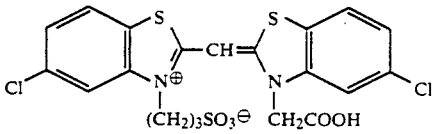

D-1

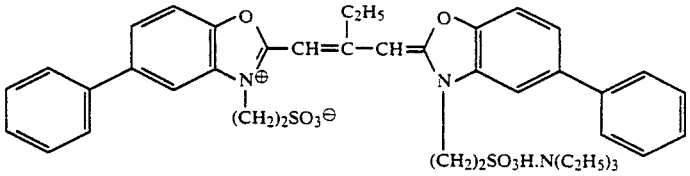

D-2

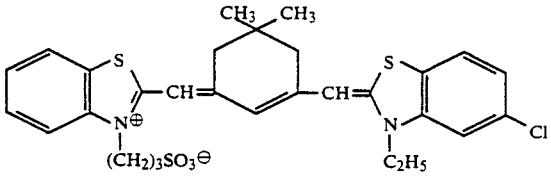

D-3

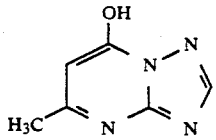

SB-5

TABLE 3

| Layer | Composition | Addition amount (g/m²) |
|---|---|---|
| 7th layer (protective layer) | Gelatin | 1.0 |
| 6th layer (ultraviolet-ray absorption layer) | Gelatin | 0.6 |
| | Ultraviolet-ray absorber (UV-1) | 0.2 |
| | Ultraviolet-ray absorber (UV-2) | 0.2 |
| | Color-mixing inhibitor (HQ-1) | 0.01 |
| | DNP | 0.2 |
| | PVP | 0.03 |
| | Anti-irradiation dye (AI-5) | 0.02 |
| 5th layer (red-sensitive layer) | Gelatin | 1.40 |
| | Red-sensitive silver chlorobromide emulsion (EmC); as silver | 0.24 |
| | Cyan coupler (C-1) | 0.17 |
| | Cyan coupler (C-2) | 0.25 |
| | Dye image stabilizer (ST-1) | 0.20 |
| | High-boiling point organic solvent (HB-1) | 0.10 |
| | Stain inhibitor (HQ-1) | 0.01 |
| | DOP | 0.30 |
| 4th layer (ultraviolet-ray absorbing layer) | Gelatin | 1.30 |
| | Ultraviolet-ray absorber (UV-1) | 0.40 |
| | Ultraviolet-ray absorber (UV-2) | 0.40 |
| | Color-mixing inhibitor (HQ-1) | 0.03 |
| | DNP | 0.40 |
| 3rd layer (green-sensitive layer) | Gelatin | 1.40 |
| | Green-sensitive silver chlorobromide emulsion (EmB); as silver | 0.27 |
| | Magenta coupler (M-1) | 0.35 |
| | Addition compound (AO-1) | 0.20 |
| | Dye image stabilizer (ST-4) | 0.10 |
| | High-boiling point organic solvent (DOP) | 0.30 |
| | Anti-irradiation dye (AI-1) | 0.01 |
| 2nd layer (intermediate layer) | Gelatin | 1.20 |
| | Color mixing inhibitor (HQ-1) | 0.12 |
| | DIDP | 0.15 |
| 1st layer (blue-sensitive layer) | Gelatin | 1.30 |
| | Blue-sensitive silver chlorobromide emulsion (EmB); as silver | 0.30 |
| | Yellow coupler (Y-2) | 0.80 |
| | Dye image stabilizer (ST-1) | 0.30 |
| | Dye image stabilizer (ST-2) | 0.20 |
| | Stain inhibitor (HQ-1) | 0.02 |
| | DNP | 0.20 |
| Support | Polyethylene laminate paper | |

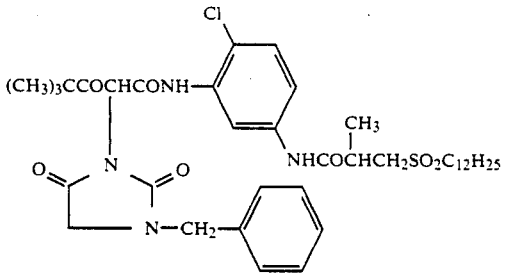

Y-2

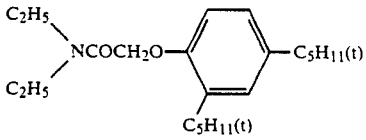

ST-2

DOP (dioctyl phthalate)
DNP (dinonyl phthalate)
DIDP (diisodecyl phthalate)
PVP (polyvinyl pyrrolidone)

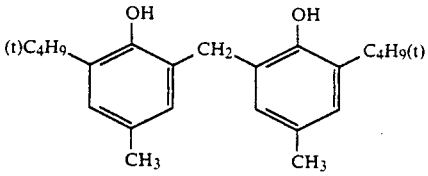

ST-4

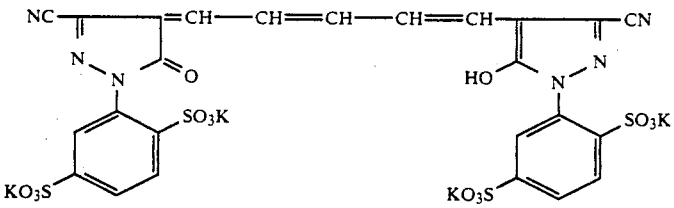

AI-5

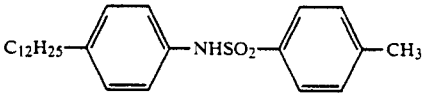

HB-1

This sample was exposed to light with conventional method and treated with the method mentioned below:

| [Treating process] | [Treating temperature] | [Treating time] |
|---|---|---|
| Color developing | 35.0 ± 0.3° C. | 45 sec |
| Bleach-fixing | 35.0 ± 0.5° C. | 45 sec |
| Stabilization | 30–34° C. | 90 sec |
| Drying | 60–80° C. | 60 sec |

(Color developer)

| | |
|---|---|
| Pure water | 800 ml |
| Triethanol amine | 10 g |
| N,N-diethyl hydroxylamine | 5 g |
| Potassium bromide | 0.02 g |
| Potassium chloride | 2 g |
| Potassium sulfite | 0.3 g |
| 1-hydroxyethylidene-1,1-diphosphonic acid | 1.0 g |
| Ethylenediaminetetraacetic acid | 1.0 g |
| Disodium catechol-3,5-disulfonate | 1.0 g |
| N-ethyl-N-β-methane sulfonamide ethyl-3-methyl-4-aminoanioine sulfate | 4.5 g |
| Fluorescent bleaching agent (4,4'-diaminostilbene disulfonic acid derivative) | 1.0 g |
| Potassium carbonate | 27 g |

By adding water to one liter and adjust pH to 10.10.

[Bleach fixer]

-continued

Bleach-fixer (one liter) contains:

| | |
|---|---|
| Ethylenediaminetetraacetic acid ferric ammonium salt dihydrate | 60 g |
| Ethylenediaminetetraacetic | 3 g |
| Ammonium thiosulfite (aqueous 70% solution) | 100 ml |
| Ammonium sulfite (aqueous 40% solution) | 27.5 ml |

Adjust pH to 5.7 with potassium carbonate or glacial acetic acid

[Stabilizer]

Stabilizer (one liter) contains:

| | |
|---|---|
| 5-chloro-2-methyl-4-isothiazoline-3-on | 1.0 g |
| Ethylene glycol | 1.0 g |
| 1-hydroxyethylidene-1,1-diphosphonic acid | 2.0 g |
| Ethylenediaminetetraacetic acid | 1.0 g |
| Ammonium hydroxide (aqueous 20% solution) | 3.0 g |
| Ammonium sulfite | 3.0 g |
| Fluorescent whitening agent (4,4'-diaminostilbene diphosphonic acid derivative) | 1.5 g |

Adjust pH to 7.0 with sulfuric acid or sodium hydroxide.

Samples 37 to 52 were prepared with the method just same as that of the above except that the third layer magenta coupler (M-1), addition compound AO-1, dispersion additive (saponin) and high-boiling point organic solvent (DOP) were changed to those as shown in the recipe in Table 4 and then exposed to light and treated as the above.

Evaluation of the samples and dispersion solution was carried out with the same process as before. Result obtained is shown in Table 4.

TABLE 4

| Sample No. | M coupler | Addition compound | Dispersion additive | High-boiling point organic solvent | Color tone | Light fastness | Dispersion stability Before the stop | Dispersion stability After the stop | Perspiration Amount of perspiration (mg/cm²) | Condition of the surface |
|---|---|---|---|---|---|---|---|---|---|---|
| 36 (Comparative) | M-1 | AO-1 | Saponin | H-2 | 528 | 74 | 23.8 | 75.4 | 0 | No perspiration |
| 37 (Comparative) | M-1 | II-6 | Saponin | H-2 | 527 | 73 | 25.4 | 82.5 | 0.02 | No perspiration |
| 38 (Comparative) | M-1 | AO-1 | IV-4 | H-2 | 527 | 73 | 23.6 | 69.9 | 0.05 | Perspiration in some extent |
| 39 (Comparative) | M-1 | II-6 | IV-4 | H-2 | 528 | 73 | 22.3 | 80.2 | 0.02 | No perspiration |
| 40 (Comparative) | I-2 | AO-1 | Saponin | H-2 | 534 | 51 | 20.5 | 336 | 0.06 | Perspiration in some extent |
| 41 (Comparative) | I-2 | II-6 | Saponin | H-2 | 535 | 71 | 25.6 | 215 | 0.13 | Oil drop occurrence |
| 42 (Comparative) | I-2 | AO-1 | IV-4 | H-2 | 535 | 48 | 20.3 | 295 | 0.08 | Oil drop occurrence |
| 43 (Invention) | I-2 | II-6 | IV-4 | H-2 | 534 | 74 | 24.8 | 43.3 | 0.02 | No perspiration |
| 44 (Invention) | I-2 | II-2 | IV-4 | H-2 | 535 | 72 | 25.2 | 39.5 | 0.01 | No perspiration |
| 45 (Invention) | I-2 | II-11 | IV-4 | H-2 | 534 | 78 | 21.7 | 35.2 | 0 | No perspiration |
| 46 (Invention) | I-2 | II-11 | III-2 | H-2 | 534 | 73 | 22.9 | 38.8 | 0 | No perspiration |
| 47 (Invention) | I-6 | II-6 | IV-4 | H-2 | 534 | 74 | 21.1 | 34.4 | 0.01 | No perspiration |
| 48 (Invention) | I-6 | II-11 | IV-4 | H-2 | 534 | 79 | 23.3 | 38.2 | 0 | No perspiration |
| 49 (Invention) | I-2 | II-6 | IV-1/IV-4 | H-2 | 535 | 77 | 25.7 | 35.7 | 0 | No perspiration |
| 50 (Invention) | I-2 | II-6 | IV-1/IV-4 | H-7 | 535 | 80 | 26.1 | 32.8 | 0 | No perspiration |
| 51 (Invention) | I-2 | II-11 | IV-1/IV-4 | H-7 | 534 | 83 | 23.4 | 33.7 | 0 | No perspiration |
| 52 (Invention) | I-11 | II-11 | IV-1/IV-4 | H-2 | 534 | 82 | 26.6 | 30.6 | 0 | No perspiration |

As shown in this table, the effect of this invention was obtained even when a high silver chloride content emulsion was used and rapid treatment was performed.

Similar good result was obtained by the use of C-3 instead of C-1.

C-3

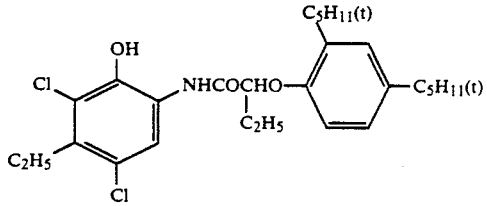

Example 3

Multi-layer silver halide color photographic light sensitive material was prepared with the composition represented in Table 5 (coating solution of each layer was same as that in Example 1).

The third layer contains magenta coupler I-2, 6, 11, 21 and 28. As the addition compound II-2, 6, 11 and 15 were used. As the dispersion additive, III-2, IV-1, 4, 5, 6 were used. By using these recipe, a multi-layer silver halide photographic light sensitive material was prepared and the effect of this invention was obtained. By changing the C-3 to C-5 in the 5th layer, the similar effect of this invention was obtained.

C-5

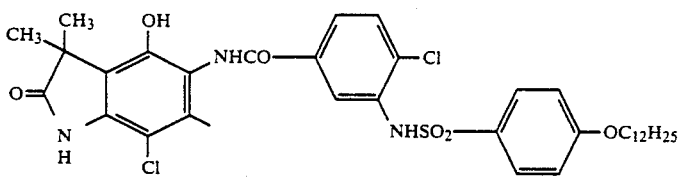

TABLE 5

| Layer | Composition | Addition amount (g/m²) |
|---|---|---|
| 7th layer (protective layer) | Gelatin | 1.0 |
| 6th layer (ultraviolet- | Gelatin<br>Ultraviolet-ray absorber (UV-3) | 0.6<br>0.03 |

TABLE 5-continued

| Layer | Composition | Addition amount ($g/m^2$) |
|---|---|---|
| ray absorption layer) | Ultraviolet-ray absorber (UV-4) | 0.12 |
| | Ultraviolet-ray absorber (UV-5) | 0.07 |
| | Color-mixing inhibitor (HQ-2) | 0.01 |
| | TINP | 0.2 |
| 5th layer (red-sensitive layer) | Gelatin | 1.40 |
| | Red-sensitive silver chlorobromide emulsion (silver bromide 80 mol %); as silver | 0.24 |
| | Cyan coupler (C-3) | 0.17 |
| | Cyan coupler (C-4) | 0.25 |
| | Ultraviolet-ray absorber (UV-3) | 0.03 |
| | Ultraviolet-ray absorber (UV-4) | 0.12 |
| | Stain inhibitor (HQ-2) | 0.01 |
| | TCP | 0.30 |
| | Antiirradiation dye (AI-4) | 0.02 |
| 4th layer (ultraviolet-ray absorbing layer) | Gelatin | 1.30 |
| | Ultraviolet-ray absorber (UV-3) | 0.06 |
| | Ultraviolet-ray absorber (UV-4) | 0.24 |
| | Ultraviolet-ray absorber (UV-5) | 0.14 |
| | Color-mixing protector (HQ-2) | 0.03 |
| | TINP | 0.40 |
| 3rd layer | Gelatin | 1.40 |

TABLE 5-continued

| Layer | Composition | Addition amount ($g/m^2$) |
|---|---|---|
| (green-sensitive layer) | Green-sensitive silver chlorobromide emulsion (silver bromide 80 mol %); as silver | 0.27 |
| | Magenta coupler (M-2) | 0.35 |
| | Addition compound (ST-6) | 0.20 |
| | Stain inhibitor (HQ-2) | 0.01 |
| | TCP | 0.15 |
| | TOP | 0.15 |
| | Antiirradiation dye (AI-3) | 0.01 |
| 2nd layer (intermediate layer) | Gelatin | 1.20 |
| | Color mixing inhibitor (HQ-2) | 0.12 |
| | TOP | 0.15 |
| 1st layer (blue-sensitive layer) | Gelatin | 1.30 |
| | Blue-sensitive silver chlorobromide emulsion (silver bromide 80 mol %); as silver | 0.30 |
| | Yellow coupler (Y-3) | 0.80 |
| | Dye image stabilizer (ST-5) | 0.30 |
| | Stain inhibitor (HQ-2) | 0.02 |
| | DBP | 0.20 |
| Support | Polyethylene laminate paper | |

Y-3

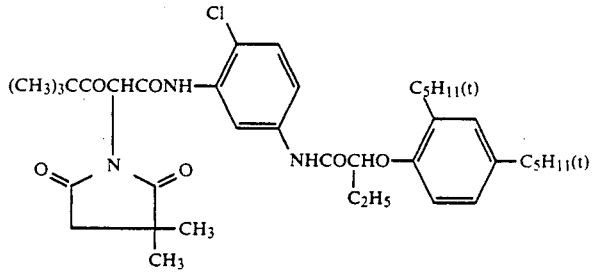

M-2

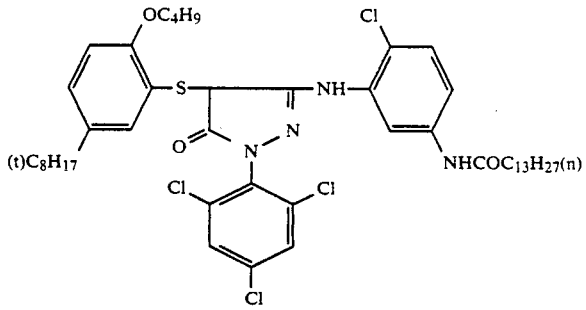

C-4

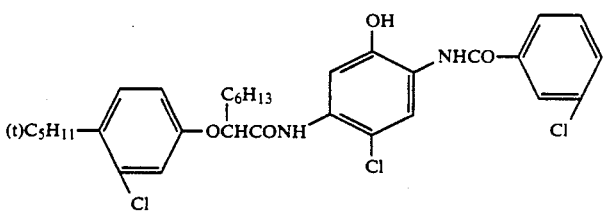

DBP (dibutyl phthalate)
TOP (trioctyl phosphate)
TCP (tricresyl phosphate)
TINP (Triisononyl phosphate)

-continued
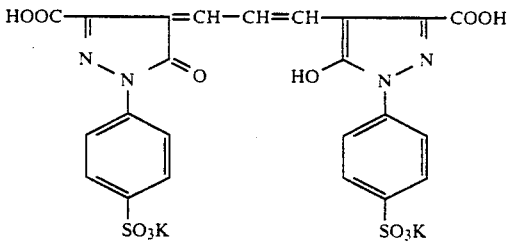
AI-3
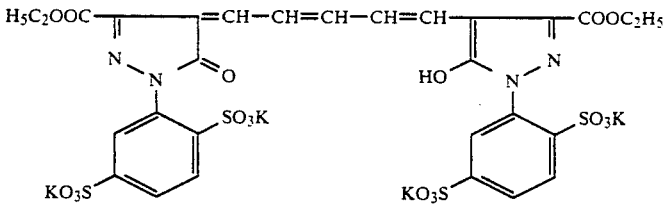
AI-4
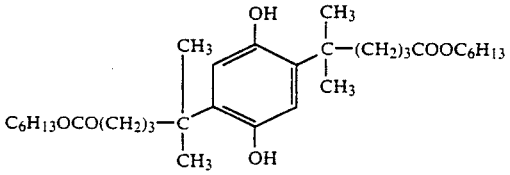
HQ-2
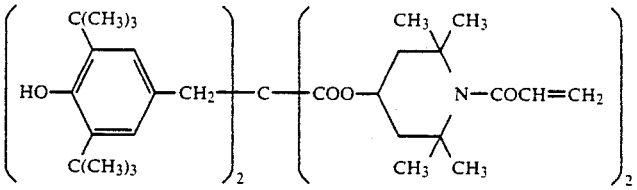
ST-5
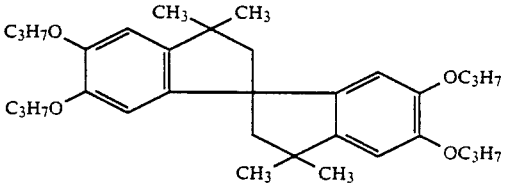
ST-6
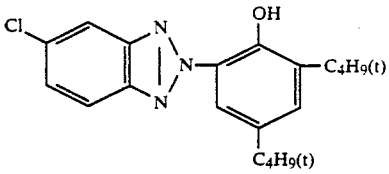
UV-3
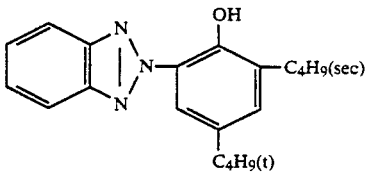
UV-4
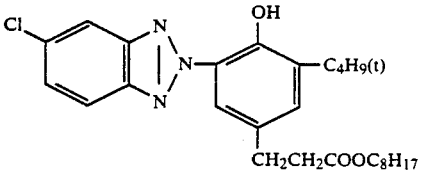
UV-5

Example 4

A sheet of paper whose both sides were coated with polyethylene was used as the support of Sample No. 4-1 color reversal photographic sensitive material. On this support below-mentioned twelve layers (coating solution of each layer was prepared with method same as that of Example 1). Each amount is shown by g/m$^2$. Amount of silver halide is converted to the amount of silver.

| | |
|---|---|
| First layer (gelatin layer): | 1.40 |
| Gelatin | |
| Second layer (antihalation layer): | |
| Black colloidal silver | 0.10 |
| Gelatin | 0.60 |
| Third layer (first red-sensitive layer): | |
| Cyan coupler C-1 | 0.14 |
| Cyan coupler C-2 | 0.07 |
| High-boiling point solvent (O-1) | 0.06 |
| AgBrI spectrally sensitized with red sensitizing dye (S-1, S-2) (AgI 3.0 mol %; mean diameter 0.4 μm) | 0.14 |
| Gelatin | 1.0 |
| Fourth layer (2nd red-sensitive layer): | |
| Cyan coupler C-1 | 0.20 |
| Cyan coupler C-2 | 0.10 |
| High-boiling point solvent (O-1) | 0.10 |
| AgBrI spectrally sensitized with red-sensitizing dye (S-1, S-2) (AgI 3.0 mol %; mean diameter 0.8 μm) | 0.16 |
| Gelatin | 1.0 |
| Fifth layer (first intermediate layer) | |
| Gelatin | 1.0 |
| Color mixing inhibitor (A-1) | 0.08 |
| Sixth layer (first green-sensitive layer) | |
| Magenta coupler (M-3) | 0.14 |
| Addition compound (AO-1) | 0.08 |
| High-boiling point solvent (0-2) | 0.15 |

-continued

| | |
|---|---|
| AgBrI spectrally sensitized with green sensitizing dye (S-3) (AgI 3.0 mol %; mean diameter 0.4 μm) | 0.15 |
| Gelatin | 1.0 |
| Seventh layer (second green-sensitive layer) | |
| Magenta coupler (C-3) | 0.14 |
| Addition compound (AO-1) | 0.08 |
| High-boiling point solvent (O-2) | 0.15 |
| AgBrI spectrally sensitized with green-sensitizing dye (S-3) AgI 3.0 mol %; mean diameter 0.7 μm) | 0.15 |
| Gelatin | 1.0 |
| Eighth layer (second intermediate layer) | |
| Yellow colloid layer | 0.15 |
| Color mixing inhibitor (A-1) | 0.08 |
| Gelatin | 1.0 |
| Ninth layer (first blue-sensitive layer) | |
| Yellow coupler (C-4) | 0.40 |
| High-boiling point solvent (O-2) | 0.10 |
| AgBrI spectrally sensitized with blue-sensitizing dye (S-4) (AgI 3.0 mol %; mean diameter 0.4 μm) | 0.15 |
| Gelatin | 0.70 |
| Tenth layer (second blue-sensitive layer): | |
| Yellow coupler (C-4) | 0.80 |
| High-boiling point solvent (O-2) | 0.20 |
| AgBrI spectrally sensitized with blue-sensitizing dye (S-4) AgI 3.0 mol %; mean diameter 0.8 μm) | 0.20 |
| Gelatin | 1.3 |
| Eleventh layer (ultraviolet-ray absorbing layer): | |
| Ultraviolet-ray absorber U-1 | 0.2 |
| Ultraviolet-ray absorber U-2 | 0.2 |
| Ultraviolet-ray absorber U-3 | 0.2 |
| Ultraviolet-ray absorber U-4 | 0.2 |
| Gelatin | 2.0 |
| Twelfth layer (protective layer): Gelatin | 2.0 |

Fading inhibitor, surface active agent, hardener and antiiradiation dye are also contained.

C-1

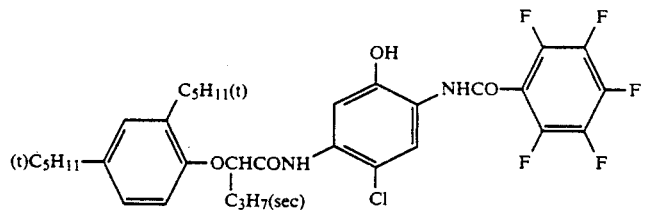

M-3

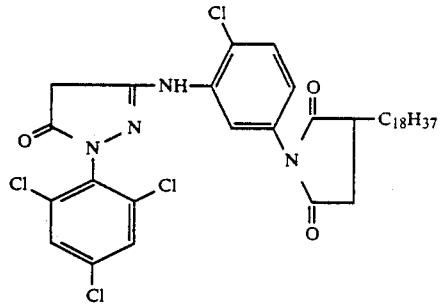

C-4

-continued
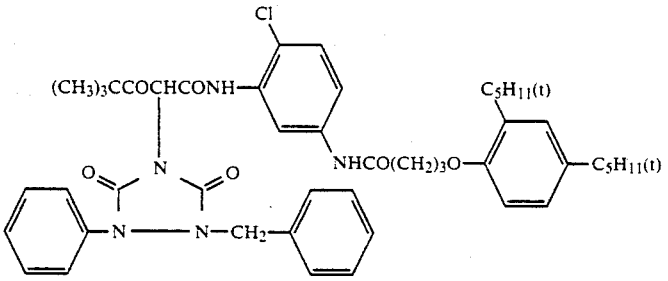
O-1
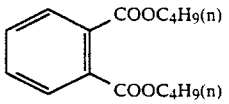
O-2
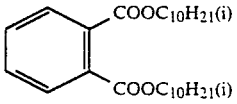
Hardener
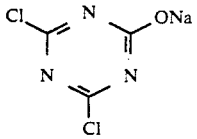
S-1
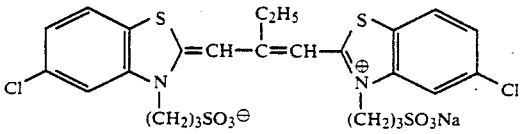
S-2
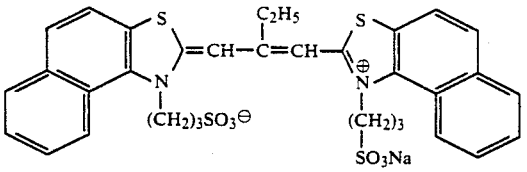
S-3
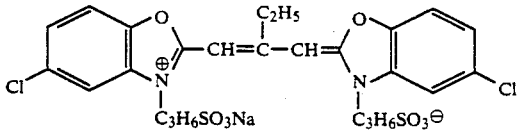
S-4
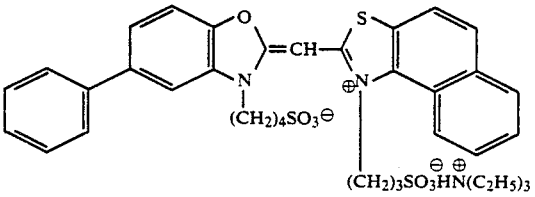
Ultraviolet-ray absorber -continued

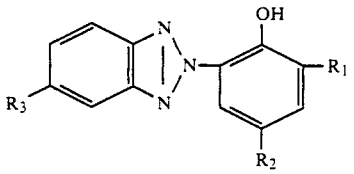

| | $R_1$ | $R_2$ | $R_3$ |
|---|---|---|---|
| U-1 | (t)$C_4H_9$ | (t)$C_4H_9$ | H |
| U-2 | (t)$C_4H_9$ | $CH_3$ | Cl |
| U-3 | (t)$C_4H_9$ | (t)$C_4H_9$ | Cl |
| U-4 | (t)$C_5H_{11}$ | (t)$C_5H_{11}$ | H |

Color mixing inhibitor (A-1)

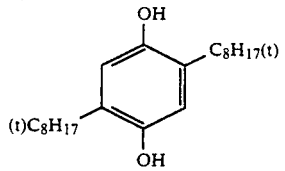

The obtained sample with above-mentioned recipe is named Sample 4-1. Samples 4-2–4-16 were prepared with a similar method to the Sample 4-1 except that magenta couplers in 6th and 7th layers (C-3), additive compound (AO-1) and dispersion additive (saponin) were changed as shown in Table 6.

Magenta wedge exposure was carried out by using Eastman-Kodak yellow filter CC-90M to these samples and the below-mentioned treatment was carried out.

| | |
|---|---|
| First developing | |
| (monochromatic developing) | 1 min 15 sec (38°C.) |
| Washing | 1 min 30 sec |
| Light fogging: not less than 100 lux; | not less than 1 sec |
| Second developing | |
| (color developing) | 2 min 15 sec (38°C.) |
| Washing | 45 sec |
| Bleach fixing | 2 min (38°C.) |
| Washing | 2 min 15 sec |
| (First developing solution) | |
| One liter of first developer contains: | |
| Potassium sulfite | 3.0 g |
| Sodium thiocyanate | 1.0 g |
| Sodium bromide | 2.4 g |
| Potassium iodide | 8.0 mg |
| Potassium hydroxide (48%) | 6.2 ml |
| Potassium carbonate | 14 g |
| Sodium bicarbonate | 12 g |
| 1-phenyl-4-methyl-4-hydroxy- | 1.5 g |

-continued

| | |
|---|---|
| methyl-3-pyrazolidone | |
| Hydroquinone monosulfonate | 23.3 g |
| | (pH = 9.65) |
| (Color developing solution) | |
| One liter of color developing solution contains: | |
| Benzyl alcohol | 14.6 ml |
| Ethylene glycol | 12.6 ml |
| Anhydrous potassium carbonate | 26 g |
| Potassium hydroxide | 1.4 g |
| Sodium sulfite | 1.6 g |
| 3,6-Dithiaoctane-1,1,8-diol | 0.24 g |
| Hydroxylamine sulfate | 2.6 g |
| 4-N-ethyl-N-β-(methanesulfonamide ethyl)-2-methyl p-phenylenediamine sesquisulfate | 5.0 g |
| (Bleach fixer) | |
| One liter of bleach fixer contains: | |
| Ammonium salt of ferric ethylene-diamine tetraacetate (1.56 mol solution) | 115 ml |
| Sodium metabisulfite | 15.4 g |
| Ammonium thiosulfate (58%) | 126 ml |
| 1,2,4-Triazole-3-thiol | 0.4 g |
| | (pH = 6.5) |

Test was carried out with methods same as shown in Example 1. results about the color tone of magenta dye image, light fastness, perspiration and static stability of dispersed solution are shown in Table 6.

TABLE 6

| Sample No. | M coupler | Addition compound | Dispersion additive | Color tone | Light fastness | Dispersion stability Before the stop | Dispersion stability After the stop | Perspiration Amount of perspiration (mg/cm²) | Condition of the surface |
|---|---|---|---|---|---|---|---|---|---|
| 4-1 (Comparative) | C-3 | AO-1 | Saponin | 529 | 72 | 25.9 | 62.2 | 0.01 | No perspiration |
| 4-2 (Comparative) | I-11 | AO-1 | Saponin | 533 | 58 | 23.4 | 452 | 0.08 | Oil drop occurrence |
| 4-3 (Comparative) | C-3 | II-2 | Saponin | 528 | 70 | 27.7 | 65.4 | 0.02 | No perspiration |
| 4-4 (Comparaitve) | I-11 | II-2 | Saponin | 533 | 63 | 22.3 | 349 | 0.11 | Oil drop occurrence |
| 4-5 (Comparative) | I-11 | AO-1 | IV-4 | 533 | 57 | 24.0 | 342 | 0.15 | Oil drop occurrence |
| 4-6 (Invention) | I-11 | II-2 | IV-4 | 534 | 70 | 24.1 | 53.1 | 0.02 | No perspiration |
| 4-7 (Invention) | I-2 | II-2 | IV-4 | 535 | 76 | 25.4 | 44.0 | 0.01 | No perspiration |
| 4-8 (Invention) | I-2 | II-6 | IV-4 | 535 | 78 | 26.6 | 40.1 | 0.005 | No perspiration |
| 4-9 (Invention) | I-2 | II-11 | IV-4 | 535 | 77 | 23.3 | 41.1 | 0.005 | No perspiration |
| 4-10 (Invention) | I-2 | II-15 | IV-4 | 534 | 73 | 20.1 | 45.5 | 0 | No perspiration |
| 4-11 (Invention) | I-19 | II-2 | IV-4 | 534 | 74 | 23.0 | 44.0 | 0 | No perspiration |
| 4-12 (Invention) | I-19 | II-6 | IV-4 | 534 | 77 | 22.0 | 42.1 | 0.01 | No perspiration |
| 4-13 (Invention) | I-21 | II-6 | IV-4 | 535 | 80 | 23.6 | 41.8 | 0.01 | No perspiration |
| 4-14 (Invention) | I-21 | II-11 | IV-4 | 534 | 79 | 21.2 | 43.7 | 0 | No perspiration |

TABLE 6-continued

| Sample No. | M coupler | Addition compound | Dispersion additive | Color tone | Light fastness | Dispersion stability Before the stop | Dispersion stability After the stop | Perspiration Amount of perspiration ($mg/cm^2$) | Condition of the surface |
|---|---|---|---|---|---|---|---|---|---|
| 4-14 (Invention) | I-2 | II-6 | IV-1/IV-4 | 534 | 80 | 21.2 | 35.6 | 0 | No perspiration |
| 4-15 (Invention) | I-2 | II-11 | IV-1/IV-4 | 534 | 80 | 20.9 | 32.2 | 0 | No perspiration |

Results shown in Table 6 clearly represent the specific effect in the combination of the recipes of this invention. It is also realized that the use of dispersion additive increases this effect.

What is claimed is:

1. A silver halide photographic light-sensitive material comprising a support having thereon a photographic silver halide emulsion layer, wherein said silver halide emulsion layer contains a magenta coupler represented by Formula I, a compound represented by Formula II and at least one compound selected from the group of compounds represented by Formula III and Formula IV;

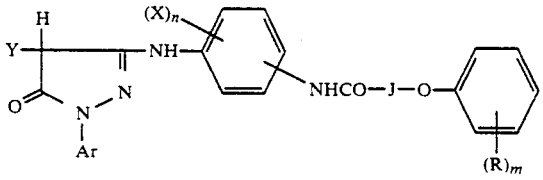

wherein Ar represents an aryl group; Y represents a hydrogen atom or a group capable of releasing by reaction with an oxidation product of a color developing agent; X represents a halogen atom, an alkyl group or an alkoxy group; J represents a divalent bonding group; R represents a halogen atom, a hydroxy group, an alkyl group, an aralkyl group or an alkoxy group; m represents an integer of 0 to 5; n represents an integer of 0 to 4;

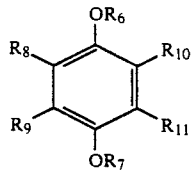

wherein $R_6$ and $R_7$ represent an alkyl group having 2 to 7 carbon atoms or an aralkyl group; $R_8$, $R_9$, $R_{10}$ and $R_{11}$ represent a hydrogen atom, an alkyl group having 4 to 8 carbon atoms or an aralkyl group, wherein three or more of $R_8$, $R_9$, $R_{10}$ and $R_{11}$ are not hydrogen atoms at the same time;

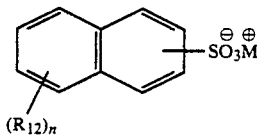

wherein $R_{12}$ represents an alkyl group having 1 to 16 carbon atoms or an aralkyl group; M represents a hydrogen atom or a cation; n represents an integer of 1 to 7;

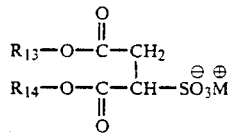

wherein $R_{13}$ and $R_{14}$ represent an alkyl group having 4 to 20 carbon atoms; M represents a hydrogen atom or a cation.

2. The material of claim 1, wherein m in Formula I is 1 and R in Formula I represents an alkyl group having 1 to 15 carbon atoms.

3. The material of claim 1, wherein Ar in Formula I represents a phenyl group having a substituent.

4. The material of claim 1, wherein J in Formula I represents a substituted or unsubstituted alkylene group.

5. The material of claim 4, wherein said J represents a substituted or unsubstituted methylene group.

6. The material of claim 1, wherein $R_6$ and $R_7$ in Formula II each represent an alkyl group or alkenyl group having 2 to 7 carbon atoms, provided that they may be the same as or different from each other.

7. The material of claim 6, wherein said $R_6$ and $R_7$ each represent an alkyl group or alkenyl group having 2 to 4 carbon atoms, provided that they may be the same as or different from each other.

8. The material of claim 1, wherein $R_9$ and $R_{10}$ in Formula II each represent a hydrogen atom.

9. The material of claim 1, wherein said magenta coupler is dissolved in a solvent having less than 6.0 of dielectric constant at 30° C.

10. The material of claim 9, wherein said solvent is a compound represented by Formula HA;

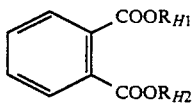

Formula HA wherein $R_{H1}$ and $R_{H2}$ each represent an alkyl group, an alkenyl group or an aryl group, provided that the sum of carbon atom numbers in said $R_{H1}$ and $R_{H2}$ is 9 to 32.

11. The material of claim 10, wherein said sum of carbon atom numbers is 16 to 24.

12. The material of claim 9, wherein said solvent is a compound represented by Formula HB;

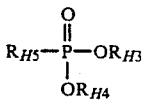

Formula HB wherein $R_{H3}$, $R_{H4}$ and $R_{H5}$ each represent an alkyl group, an alkenyl group or an aryl group, provided that the sum of carbon atom numbers in said $R_{H3}$, $R_{H4}$ and $R_{H5}$ is 24 to 54.

13. The material of claim 12, wherein said compound is at least one selected from the group consisting of compounds represented by H-12, H-13, H-14, H-15, H-16, H-17 and H-18 shown below;
H-12
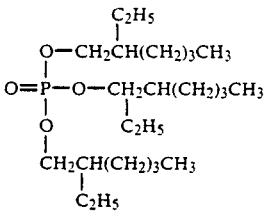
H-13
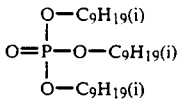
-continued
H-14
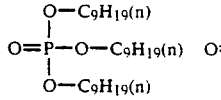
H-15
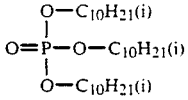
H-16
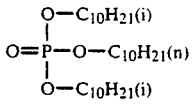
H-17
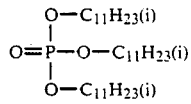
H-18
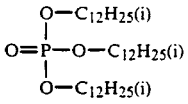
* * * * *